US011866128B2

(12) United States Patent
L'Heureux et al.

(10) Patent No.: US 11,866,128 B2
(45) Date of Patent: Jan. 9, 2024

(54) BARRIER ACCESSORY DEVICE FOR A WATERCRAFT AND WATERCRAFT HAVING SAME

(71) Applicant: BOMBARDIER RECREATIONAL PRODUCTS INC., Valcourt (CA)

(72) Inventors: Marc-Andre L'Heureux, Bromont (CA); Patrick Grondin, St-Denis de Brompton (CA); Karl Dery St-Cyr, St-Denis de Brompton (CA); Abdelkarim Meskine, Valcourt (CA)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 172 days.

(21) Appl. No.: 17/577,720

(22) Filed: Jan. 18, 2022

(65) Prior Publication Data

US 2022/0227461 A1 Jul. 21, 2022

Related U.S. Application Data

(60) Provisional application No. 63/138,624, filed on Jan. 18, 2021.

(51) Int. Cl.
*B63B 17/04* (2006.01)
*B63B 7/04* (2020.01)

(52) U.S. Cl.
CPC ..... *B63B 7/04* (2013.01)

(58) Field of Classification Search
CPC . B63B 17/00; B63B 17/04; B63B 2017/0054; B63B 69/00; B63B 2221/20
USPC ..... 114/343, 364
See application file for complete search history.

(56) References Cited

U.S. PATENT DOCUMENTS 6,561,117 B1 * 5/2003 Kell ..... B63B 25/002 114/364
8,381,372 B1 * 2/2013 Arnall ..... B25B 5/082 24/328

* cited by examiner

*Primary Examiner* — Daniel V Venne
(74) *Attorney, Agent, or Firm* — BCF LLP

(57) ABSTRACT

A barrier accessory device for a watercraft includes: an accessory connection base configured for having at least one accessory removably connected thereto; a first rail connector connected to the accessory connection base at a first end portion thereof, the first rail connector having a slot-engaging member configured to be inserted into a slot defined in one of an upper rail and a lower rail of a barrier structure of the watercraft; and a second rail connector connected to the accessory connection base at a second end portion thereof opposite the first end portion, the second rail connector having a locking assembly configured to be selectively locked onto an other one of the upper rail and the lower rail.

20 Claims, 32 Drawing Sheets

BARRIER ACCESSORY DEVICE FOR A WATERCRAFT AND WATERCRAFT HAVING SAME

CROSS-REFERENCE

The present application claims priority from U.S. Provisional Patent Application No. 63/138,624, filed Jan. 18, 2021, the entirety of which is incorporated by reference herein.

FIELD OF TECHNOLOGY

The present technology relates to watercraft having barrier structures, and in particular to accessory devices configured to be secured thereto.

BACKGROUND

Some recreational watercraft such as pontoon boats include a barrier structure (or "wall") that surrounds the periphery of the deck of the watercraft. On other types of recreational watercraft, for example deck boats, bowriders, fishing boats and center consoles, the barrier structure is known as a gunwale or gunnel. These structures act as rails that can be held onto by users aboard the watercraft, in addition to preventing users and objects from inadvertently falling off the deck.

In some cases, the barrier structure of a watercraft is used to secure certain accessories to a handrail thereof such as a wakeboard or paddle board, a fishing rod, a barbecue, a small table, storage or other accessories. However, connection devices for securing these accessories to the barrier structure can take time to secure to the barrier structure, namely requiring the use of one or more tools. In other cases, the connection devices may only allow small and/or light accessories to be connected to the barrier structure.

In view of the foregoing, there is a need for a barrier accessory device for a watercraft that addresses at least some of these drawbacks.

SUMMARY

It is an object of the present technology to ameliorate at least some of the inconveniences present in the prior art.

According to an aspect of the present technology, there is provided a barrier accessory device for a watercraft. The watercraft has a deck and a barrier structure connected to the deck. The barrier structure has upper and lower rails. The barrier accessory device comprises: an accessory connection base configured for having at least one accessory removably connected thereto; a first rail connector connected to the accessory connection base at a first end portion thereof, the first rail connector comprising a slot-engaging member configured to be inserted into a slot defined in one of the upper rail and the lower rail; and a second rail connector connected to the accessory connection base at a second end portion thereof opposite the first end portion, the second rail connector comprising a locking assembly configured to be selectively locked onto an other one of the upper rail and the lower rail.

In some embodiments, the one of the upper rail and the lower rail is the lower rail; the first rail connector is a lower rail connector configured to engage the lower rail; and the second rail connector is an upper rail connector configured to engage the upper rail.

In some embodiments, the locking assembly comprises: a fixed member connected to the accessory connection base; and a locking member operatively connected to the fixed member. The locking member is movable relative to the fixed member between: a locked position for the locking assembly to lock onto the other one of the upper rail and the lower rail; and an unlocked position for the locking assembly to release the other one of the upper rail and the lower rail.

In some embodiments, the locking assembly further comprises a pivot member pivotably connecting the locking member to the fixed member; and the locking member is pivotable between the locked and unlocked positions about a pivot axis defined by the pivot member.

In some embodiments, in use, the pivot axis extends in a direction generally parallel to the other one of the upper rail and the lower rail at a portion thereof to which the locking assembly is locked onto.

In some embodiments, the locking member pivots from the locked position to the unlocked position inwardly in a direction away from the accessory connection base.

In some embodiments, the pivot axis is a first pivot axis; the locking member is pivotable relative to the fixed member about a second pivot axis defined by the pivot member; and the first pivot axis is generally parallel to the second pivot axis.

In some embodiments, the pivot member comprises a first pivot feature and a second pivot feature defining the first pivot axis and the second pivot axis respectively; the first pivot feature is pivotably connected to the fixed member; and the second pivot feature is pivotably connected to the locking member.

In some embodiments, one of the fixed member and the locking member comprises a latch; an other one of the fixed member and the locking member defines a latch-receiving recess; in the locked position of the locking member, the latch is received and retained in the latch-receiving recess; and in the unlocked position of the locking member, the latch is removed from the latch-receiving recess.

In some embodiments, the fixed member comprises the latch and the locking member defines the latch-receiving recess.

In some embodiments, the latch is integrally made with a remainder of the fixed member.

In some embodiments, in the locked position of the locking member, the fixed member and the locking member are configured to, together, form a shape that interlocks with a shape of a cross-sectional profile of the other one of the upper rail and the lower rail.

In some embodiments, the cross-sectional profile is generally I-shaped and has: a wide upper portion; a wide lower portion; and a narrow intermediate portion extending between the wide upper and lower portions. In the locked position of the locking member, the shape formed by the fixed member and the locking member interlocks with at least part of the generally I-shaped cross-sectional profile.

In some embodiments, the fixed member comprises a protruding portion configured to extend into a recess on one side of the cross-sectional profile, the recess being defined by the wide upper portion, the wide lower portion and the narrow intermediate portion.

In some embodiments, the locking member comprises a hook portion configured to extend into a recess on one side of the cross-sectional profile, the recess being defined by the wide upper portion, the wide lower portion and the narrow intermediate portion.

In some embodiments, in use, in the locked position of the locking member, the fixed member and the locking member together surround at least a majority of the wide upper portion of the cross-sectional profile.

In some embodiments, the slot-engaging member is generally hook-shaped.

In some embodiments, the slot of the lower rail faces upwardly; and the slot-engaging member of the lower rail connector is insertable into the slot.

In some embodiments, a position of at least one of the first and second rail connectors is adjustable relative to the accessory connection base.

In some embodiments, the at least one of the first and second rail connectors is translatable relative to the accessory connection base towards and away from the other of the first and second rail connectors.

In some embodiments, the accessory connection base comprises at least one accessory attachment feature configured to removably connect the accessory thereto.

In some embodiments, at least one of the at least one accessory attachment feature is an opening defined by the accessory connection base, the opening having a shape corresponding to a shape of an accessory attachment feature connected to the accessory.

In some embodiments, the opening has a generally hexagonal shape.

In some embodiments, the opening has an elongated hexagonal shape.

In some embodiments, the at least one accessory attachment feature includes: a first anchor fixture disposed at the first end portion of the accessory connection base, the first anchor fixture defining a fastener aperture configured to receive a tongue connected to the accessory; and a second anchor fixture disposed at the second end portion of the accessory connection base, the second anchor fixture defining an anchor aperture configured to receive an anchor connected to the accessory, the first anchor fixture and the second anchor fixture collaboratively retaining the accessory to the accessory connection base.

In some embodiments, a watercraft comprises: a deck; a hull supporting the deck; a barrier structure connected to the deck, the barrier structure comprising an upper rail and a lower rail extending below the upper rail; and the barrier accessory device mounted to the barrier structure.

In some embodiments, the watercraft further comprises an accessory mounted to the accessory connection base of the barrier accessory device.

Embodiments of the present technology each have at least one of the above-mentioned objects and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of embodiments of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

A watercraft 10 configured to be equipped with an accessory device 200 (FIG. 9) according to one embodiment of the present technology is shown in FIGS. 1 to 4. In this embodiment, the watercraft 10 is a pontoon boat 10. Those of ordinary skill in the art will recognize that there are other known types of watercraft incorporating different designs that could also be configured to be equipped with the accessory device 200. The accessory device 200, shown in detail in FIGS. 9 to 16, is configured to be secured to a barrier structure 50 of the boat 10 and therefore may be referred to as the barrier accessory device 200. As will be explained in greater detail below and shown in FIGS. 30 to 32, the barrier accessory device 200 functions as an interface for attaching accessories such as a jerry can (i.e., a fuel container), a cargo box, a cargo bag, a board holder, other types of storage containers and/or any other suitable equipment to the barrier structure 50 of the boat 10.

Figure 1:
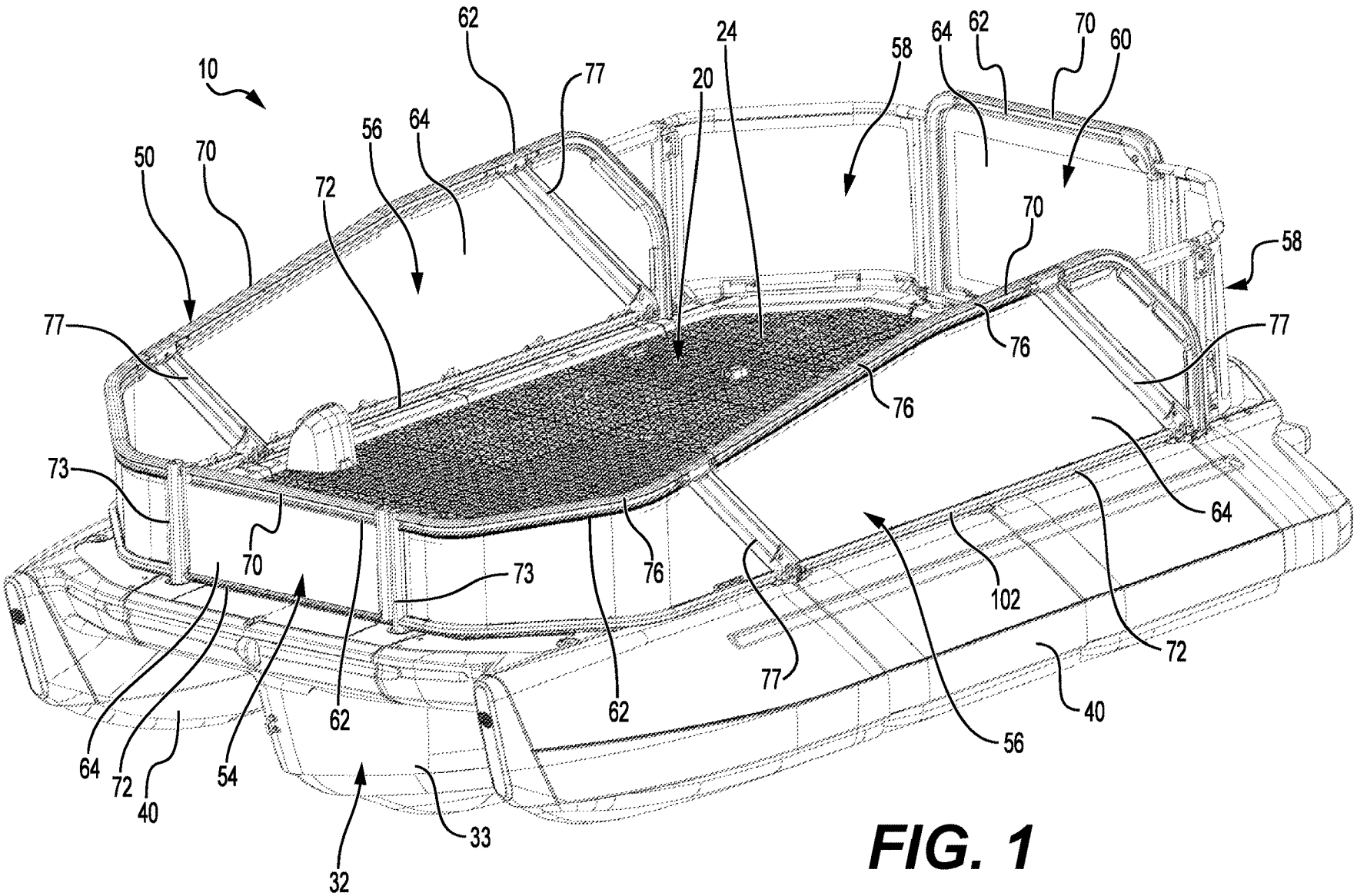
FIG. 1 is a perspective view, taken from a top, front, left side, of a pontoon boat configured to be equipped with a barrier accessory device.
Figure 2:
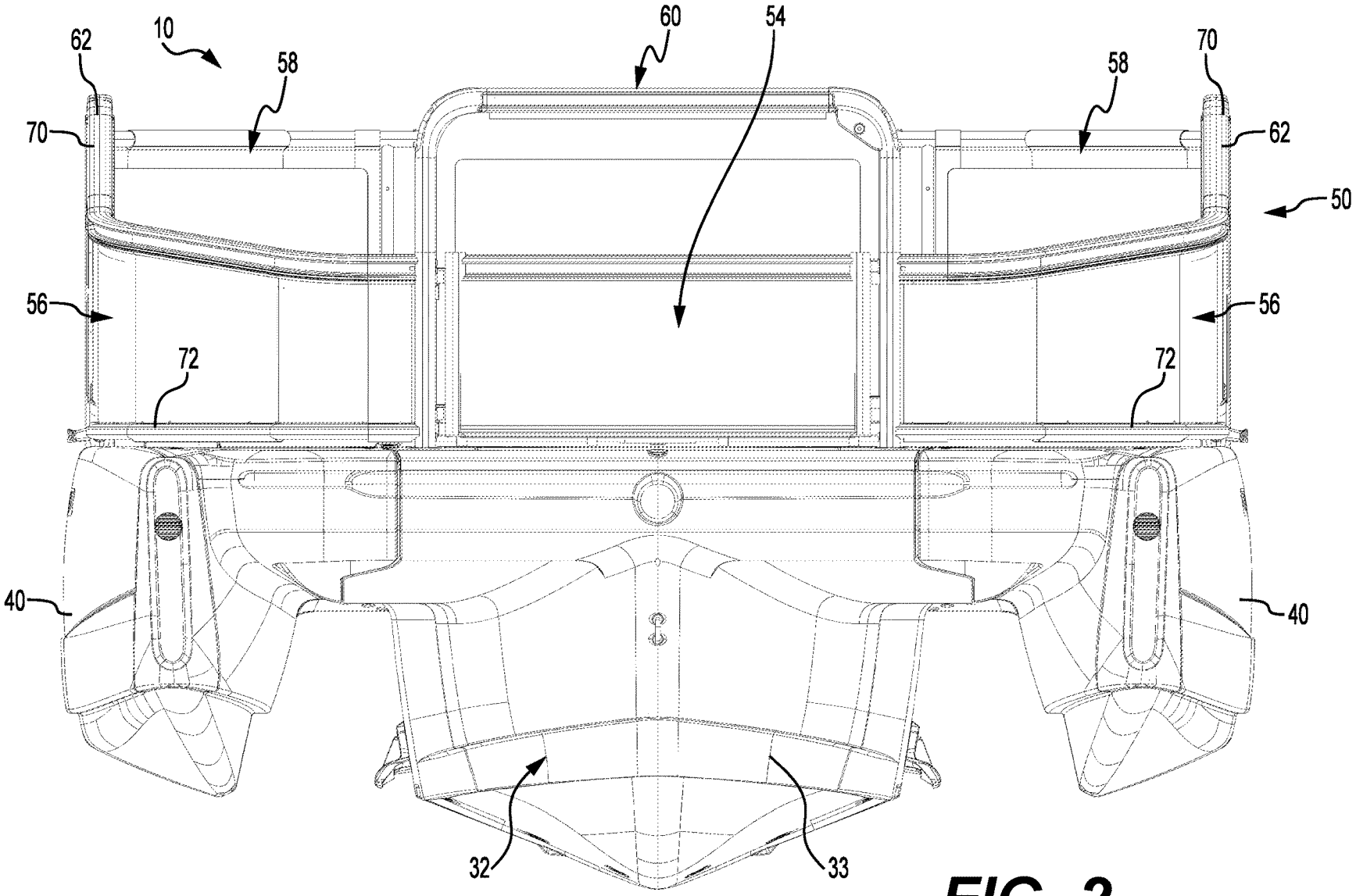
FIG. 2 is a front elevation view of the pontoon boat of FIG. 1.
Figure 3:
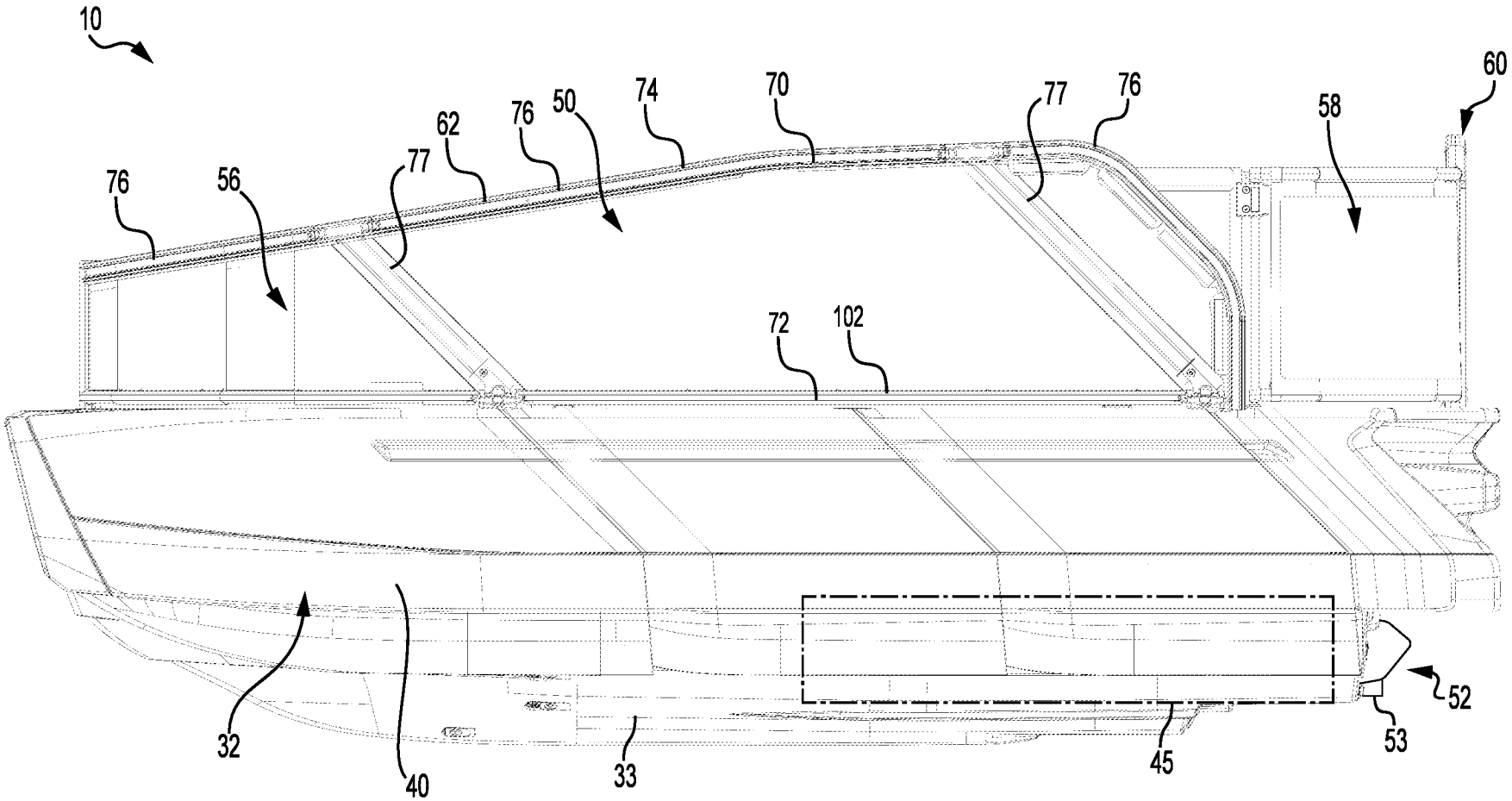
FIG. 3 is a left side elevation view of the pontoon boat of FIG. 1.

As shown in FIG. 1, the boat 10 has a deck 20 and a hull 32 supporting the deck 20. In this embodiment, the hull 32 includes three separate laterally-adjacent portions that are connected to one another to form the hull 32. Notably, the hull 32 has a central portion 33 and left and right lateral portions 40. These different hull portions could be considered separate hulls in some cases and thus the boat 10 may be referred to as a multihull watercraft in some cases. Nevertheless, it is contemplated that the hull 32 may constitute a single integral portion in other embodiments and/or be differently sized and shaped.

Figure 4:
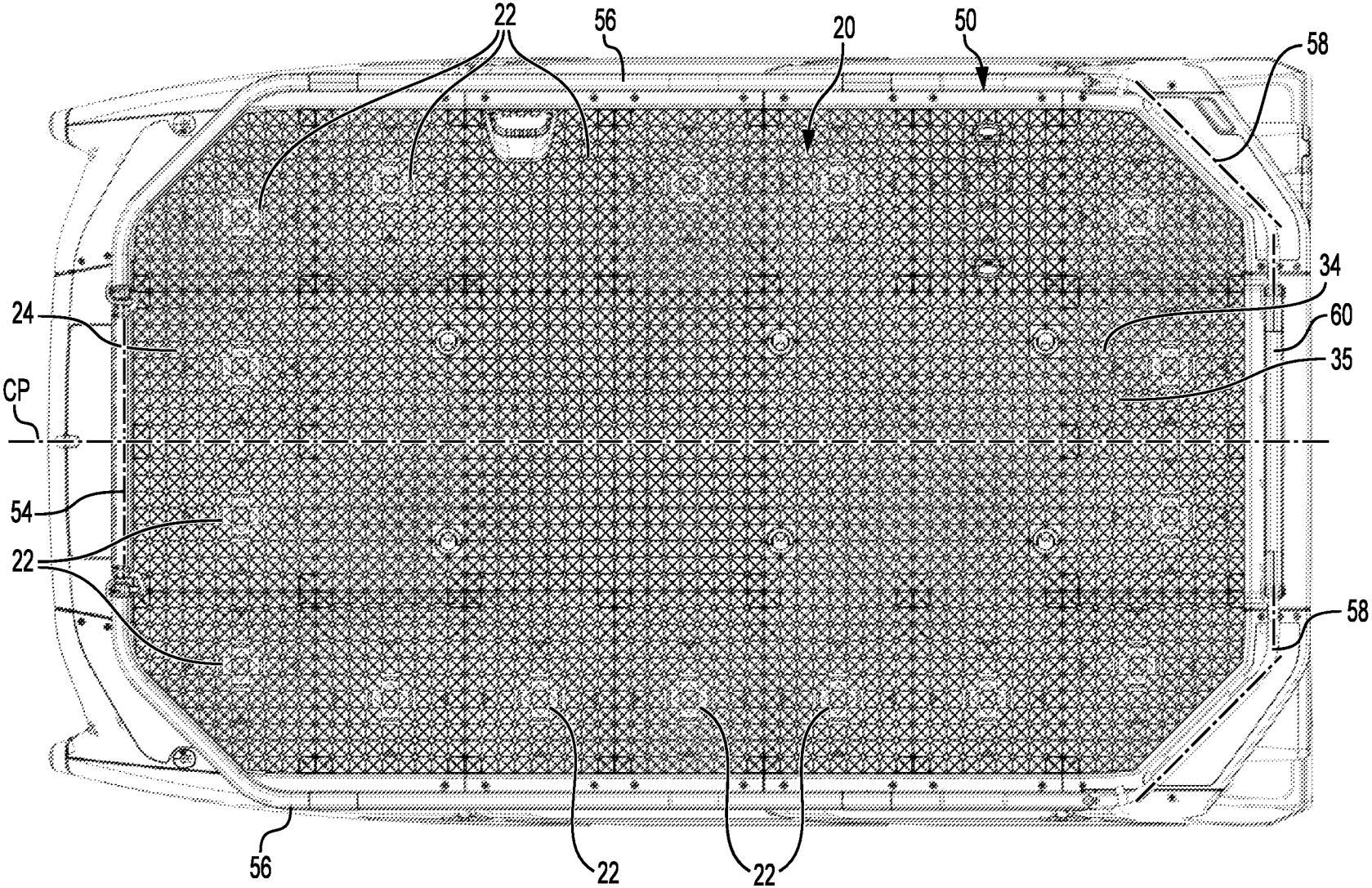
FIG. 4 is a top plan view of the pontoon boat of FIG. 1.

The deck 20 extends above the hull 32 and is supported thereby. The deck 20 has an upper surface 24 for supporting occupants, as well as accessories and accommodations of the boat 10 (e.g., seating, command console, etc.). In this embodiment, as shown in FIGS. 1 and 4, the deck 20 includes a plurality of tiles 22 which are configured for attachment of accessories thereto. The tiles 22 form a portion of the upper surface 24 of the deck 20. A more detailed description of the configuration of the tiles 22 and the manner in which they are used for attachment of accessories can be found in U.S. patent application Ser. No. 16/887,481, filed May 29, 2020, which is incorporated herein by reference. It is contemplated that the deck 20 could have a different construction than that provided by the tiles 22. For instance, the deck 20 could have a more conventional construction such as including a metallic frame and an overlying flooring layer, such as wooden panels or plywood. It is further contemplated that the deck 20 could include multiple levels and/or seating or other accessories integrated therein.

In this embodiment, the hull 32 and the deck 20 of the boat 10 have a modular construction. Notably, the hull 32 includes various modular units that are connected to one another to form the hull 32. In particular, the modular units of the hull 32 are longitudinally-adjacent to one another and therefore hulls of different sizes can be assembled depending on how many modular units are connected to one another. Similarly, the deck 20 is modular due to its construction by the tiles 22. Therefore, as will be understood, the boat 10 can have different lengths depending on the modular construction the deck 20 and the hull 32. A detailed description of the modular construction of the central portion 33 and the left and right lateral portions 40 of the hull 32 is provided, respectively, in U.S. patent application Ser. No. 17/039,625, and U.S. patent application Ser. No. 17/038,662, both filed on Sep. 30, 2020, the entirety of each of which is incorporated by reference herein. It is contemplated that the hull 32 and the deck 20 could be non-modular in other embodiments.

The boat 10 is propelled by a jet propulsion system 52 (shown in part in FIG. 3) powered by a motor (not shown). The jet propulsion system 52 has a steering nozzle 53 used for steering the boat 10. A handlebar (not shown) is operatively connected to the steering nozzle 53. A throttle lever (not shown) is operatively connected to the motor for controlling operation of the motor. The handlebar and the throttle lever are located on a command console provided on the deck 20. The command console is not shown in the figures in order to properly show the upper surface 24 of the deck 20. It is contemplated that other propulsion systems, such as a stern drive or a marine outboard engine, may be used to propel the boat 10. It is also contemplated that the handlebar could be replaced by a steering wheel and that the steering nozzle 53 could be replaced by an outdrive or one or more rudders.

A powerpack 45 (schematically illustrated in FIG. 3) of the boat 10, including the jet propulsion system 52 and the motor, is enclosed in part by the hull 32. As shown in FIG. 4, a central hull cover 34 overlies the powerpack 45 to partly enclose the powerpack 45 between the hull 32 and the hull cover 34. An upper surface 35 of the central hull cover 34 is contiguous with the upper surface 24 of the deck 20 (i.e., flush therewith).

Returning now to FIG. 1, the barrier structure 50 surrounds at least part of the deck 20 and extends upwardly therefrom. In particular, the barrier structure 50 is located along a periphery of the boat 10 (as defined by the deck 20)

to prevent occupants or objects on the deck 20 from accidentally falling off the boat 10. As shown in FIGS. 1 and 4, in this embodiment, the barrier structure 50 generally surrounds the entirety of the deck 20. Notably, the barrier structure 50 includes a front end portion 54, left and right lateral portions 56, left and right rear corner portions 58, and a rear end portion 60. It is contemplated that the barrier structure 50 could only partially surround the deck 20. For example, one or more of the portions 54, 56, 58, 60 could be omitted. A more detailed description of the construction of the barrier structure 50 can be found in U.S. Provisional Patent Application No. 62/968,303, filed Jan. 31, 2020, the entirety of which is incorporated by reference herein. A brief description of the barrier structure 50 will be provided herein to provide context regarding the installation of the barrier accessory device 200.

Figure 5:
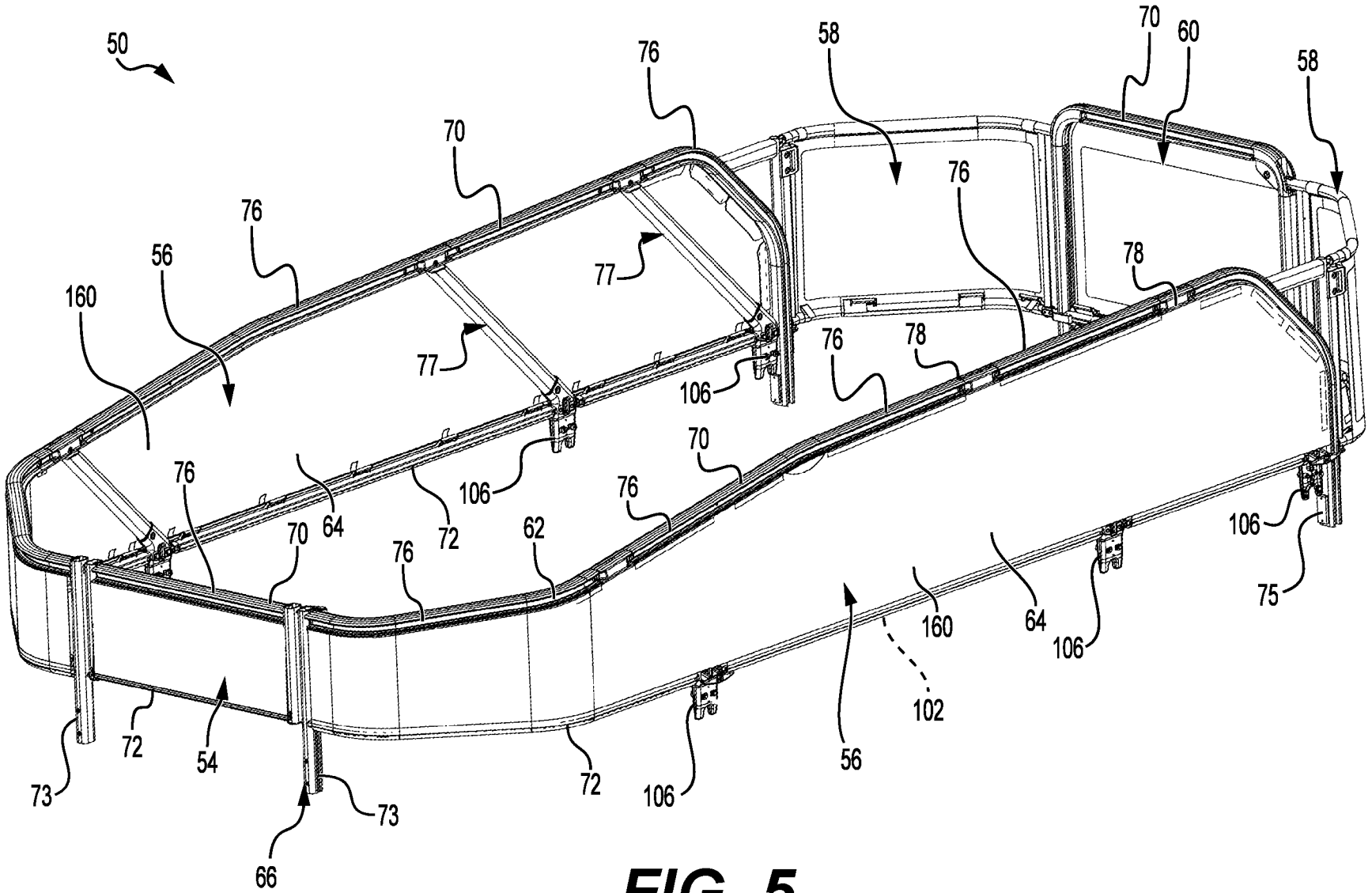
FIG. 5 is a perspective view, taken from a top, front, left side, of a barrier structure for the pontoon boat of FIG. 1 in accordance with another embodiment.

In this embodiment, the barrier structure 50 is adaptable to the different possible lengths of the boat 10 mentioned above with regard to the modular construction of the deck 20 and the hull 32. In other words, depending on the modular construction of the deck 20 and the hull 32, the barrier structure 50 can be made longer or shorter accordingly. More specifically, as shown in FIG. 5, the lateral portions 56 of the barrier structure 50 can be made longer by including additional frame members thereof. As the left and right lateral portions 56 are mirror images of one another about a longitudinal centerplane CP (FIG. 4) of the boat 10, only the left lateral portion 56 will be described in detail herein. It is to be understood that the same description applies to the right lateral portion 56. Moreover, the front end portion 54 and the rear end portion 60 of the barrier structure 50 have a similar construction.

As shown in FIG. 5, the lateral portion 56 of the barrier structure 50 has a frame 62 and a pliable sheet wall 64 connected thereto. The frame 62 connects the lateral portion 56 to the hull 32 of the boat 10. The frame 62 extends generally longitudinally from a front end 66 to a rear end 68. The frame 62 has an upper portion 70 and a lower portion 72 connected to one another. Notably, a front end member 73, a rear end member 75 and a plurality of support members 77 (shown for the right lateral portion 56 of the barrier structure in FIG. 5) extend between the upper and lower portions 70, 72 of the frame 62. The front and rear end members 73, 75 are connected to the hull 32.

The upper portion 70 of the frame 62 includes an upper rail 74 configured for grabbing by a user's hand. The upper rail 74 is thus also commonly referred to as a "hand rail" or a "grab rail". Notably, the upper rail 74 can be defined as a structure that can be grabbed by a user's hand and extends at the minimum 24 inches above the deck 20, in compliance with American Boat and Yacht Council (ABYC) H-41 regulations on "Reboarding Means, Ladders, Handholds, Rails and Lifelines". The upper rail 74 includes a plurality of upper rail members 76 that are connected to one another by interconnectors 78 extending between consecutive ones of the upper rail members 76. Notably, each interconnector 78 is fastened to two of the upper rail members 76. The interconnectors 78 are also used for connecting the support members 77 between the upper and lower portions 70, 72 of the frame 62.

As will be understood from comparing the barrier structures 50 of FIGS. 1 and 5, the length of the lateral portion 56 of the barrier structure 50 can be changed simply by adding or removing upper rail members 76 to make the rail 74 longer or shorter. This allows adapting the barrier structure 50 in accordance with the size of the boat 10 that it is intended to be installed on.

Figure 6:
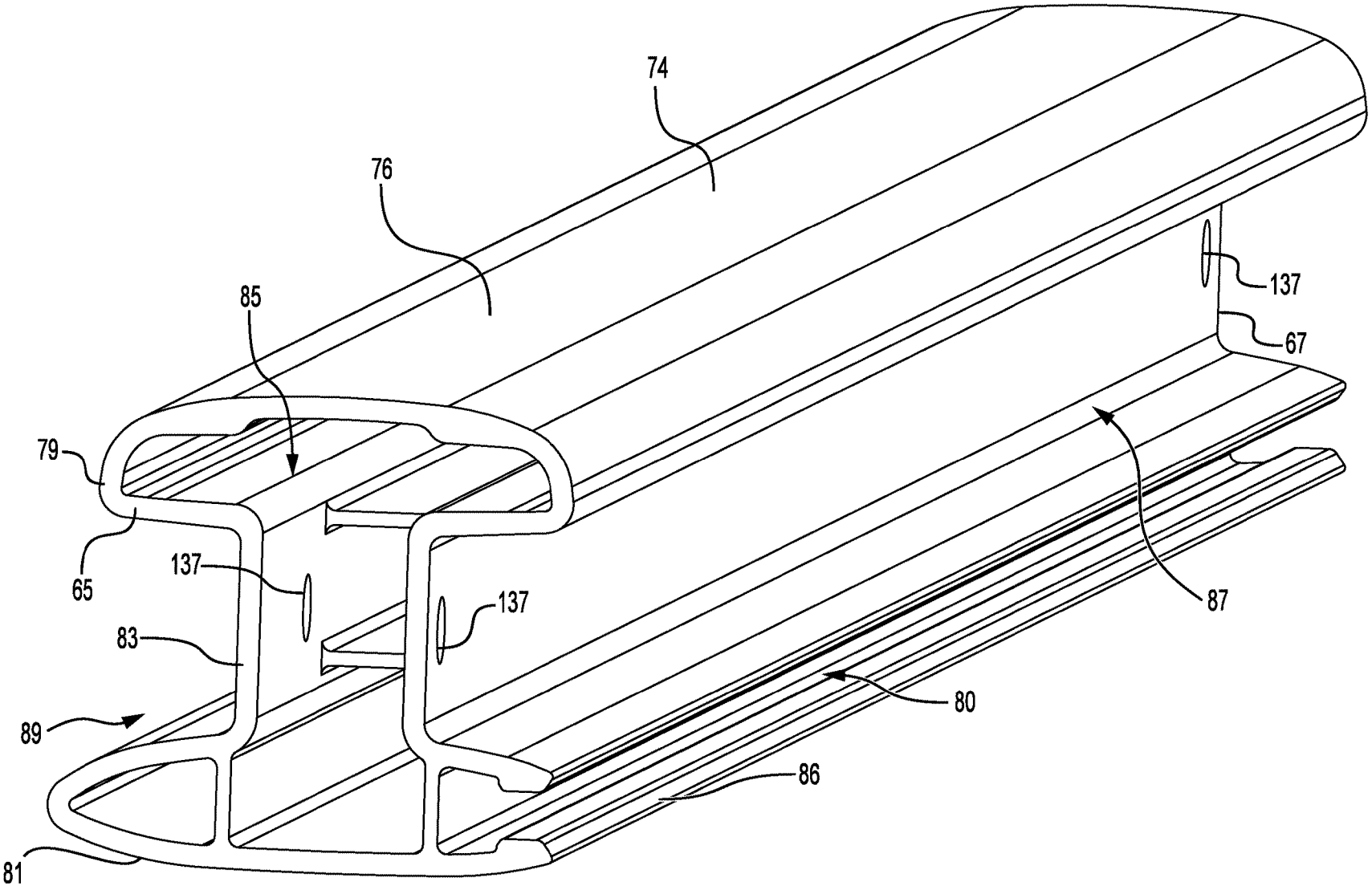
FIG. 6 is a perspective view, taken from a top, front, left side, of part of an upper rail of a left lateral portion of the barrier structure of FIG. 5.
Figure 22A:
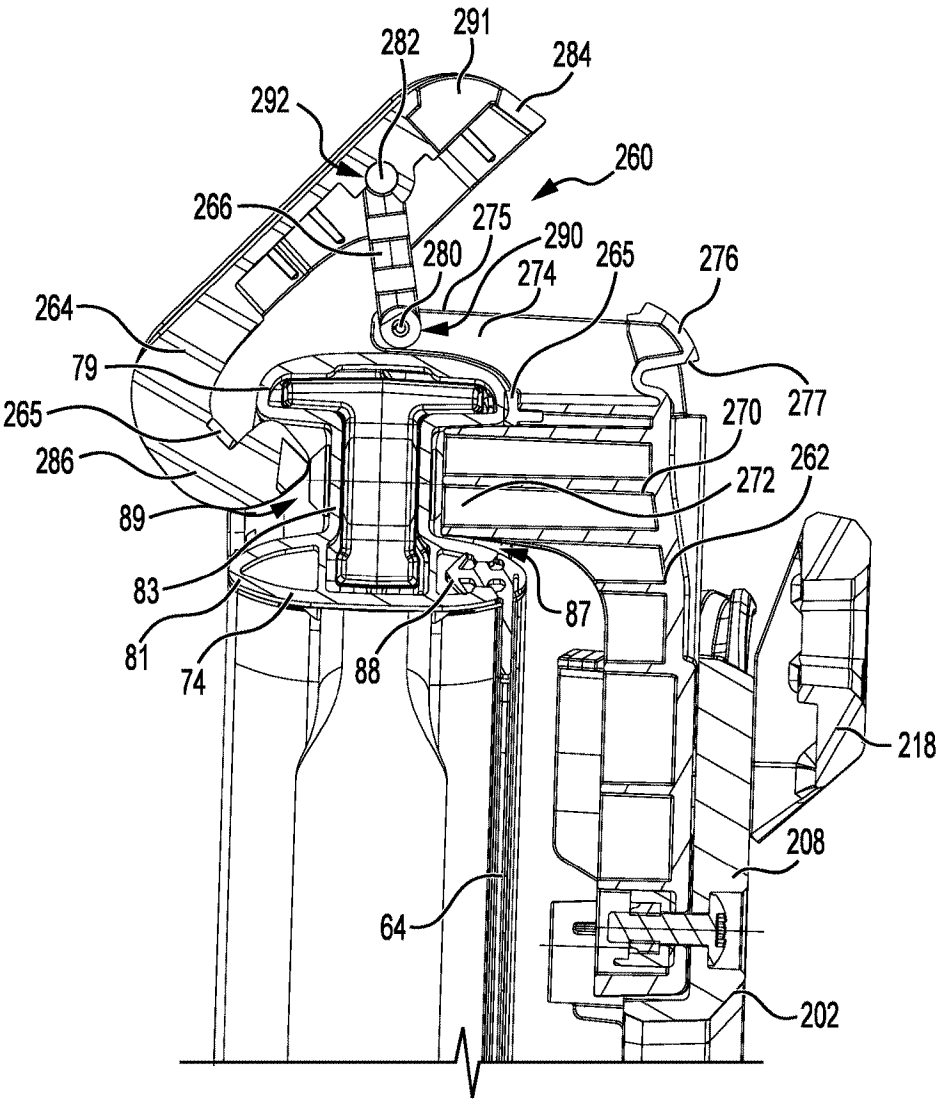
FIG. 22A is a detailed view of part of FIG. 21, showing the upper rail connector of the barrier accessory device.

In this embodiment, each upper rail member 76 has the cross-sectional profile shown in FIG. 6. Therefore, only one of the upper rail members 76 will be described herein. As can be seen, the cross-sectional profile of the upper rail member 76 is generally I-shaped, notably including a wide upper portion 79, a wide lower portion 81 and a narrow intermediate portion 83 extending between the wide upper and lower portions 79, 81. In this embodiment, the upper rail member 76 is an extruded component and defines an interior hollow space 85 therein. In this embodiment, in order to connect the pliable sheet wall 64 to the upper rail 74, the rail member 76 defines a channel 80 extending along a length of the upper rail member 76, namely between its opposite ends 65, 67. The channel 80 is configured to receive an interlocking member 88 (shown in FIG. 22A) of the pliable sheet wall 64 for connecting the pliable sheet wall 64 to the upper rail 74. As shown in FIG. 6, the channel 80 is defined by the wide lower portion 83 of the upper rail member 76 on a laterally-outward side thereof such that the channel 80 extends along a laterally-outward side of the upper rail member 76 and thus of the upper rail 74.

Turning now to the lower portion 72 of the frame 62, the lower portion 72 includes a lower rail 102 that extends below the upper rail 74. The lower rail 102 extends generally parallel to the upper surface 24 of the deck 20. The lower rail 102 has a plurality of lower rail members 104 that are interconnected to one another by lower frame connectors 106 (FIG. 5). The lower frame connectors 106 also connect the lower rail 102 to the hull 32. Notably, the lower frame connectors 106 extend downwardly from the lower rail 102 into a recess defined between the hull 32 and the deck 20 to connect to a member of the hull 32 therein.

Figure 8:
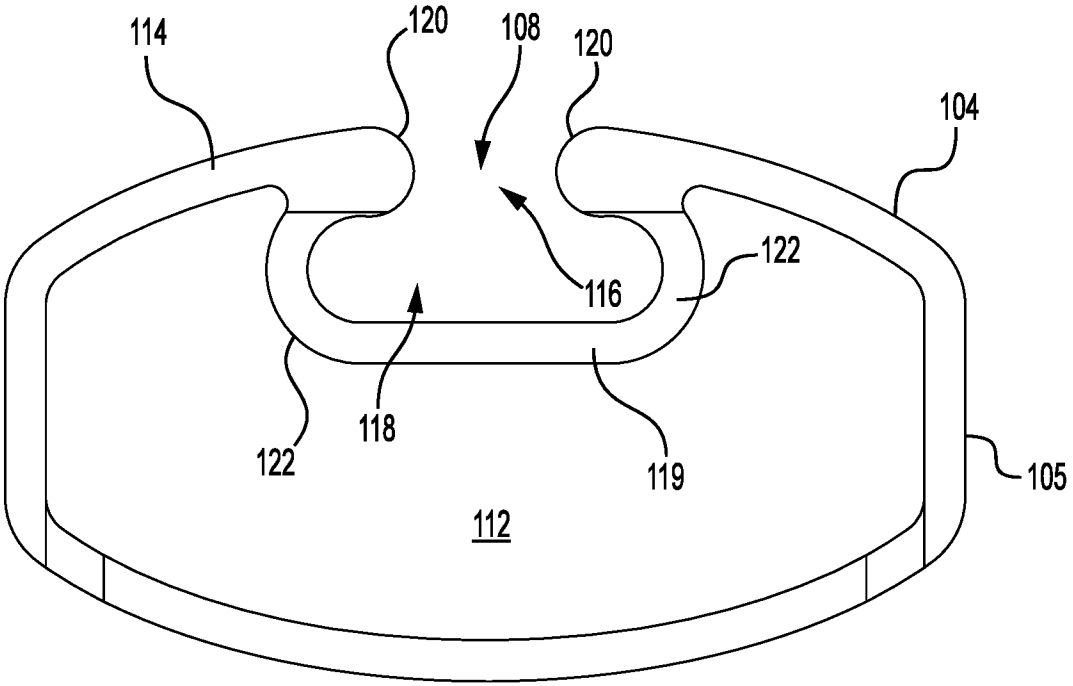
FIG. 8 is a cross-sectional view of lower rail of FIG. 7 taken along line 8-8 in FIG. 7.

In this embodiment, each lower rail member 104 has the cross-sectional profile shown in FIG. 8. Therefore, only one of the lower railing members 104 will be described in detail herein. As can be seen, in this embodiment, the cross-sectional profile of the lower rail member 104 is generally oval with two truncated ends. In this embodiment, the lower rail member 104 is an extruded component having an outer wall 105 defining an interior hollow space 112 therein. An upper portion 114 of the outer wall 105, facing upwardly toward the upper portion 70 of the frame 62, defines a slot 108 configured to receive therein one or more lower anchors (not shown) which are configured to connect the lower edge of the pliable sheet wall 64 to the lower rail 102. The slot 108 thus faces upwardly toward the upper rail 74. The anchor mounting slot 108 has a narrow section 116 and an enlarged section 118 that is wider than the narrow section 116. The narrow section 116 of the slot 108 is defined by two rounded upper ends 120 disposed opposite one another. An interior wall 119 defines the enlarged section 118 of the slot 108. The interior wall 119 extends downwardly from the upper ends 120 to form two curved lateral ends 122 of the enlarged section 118 of the slot 108, and extends horizontally between the two lateral ends 122.

Figure 7:
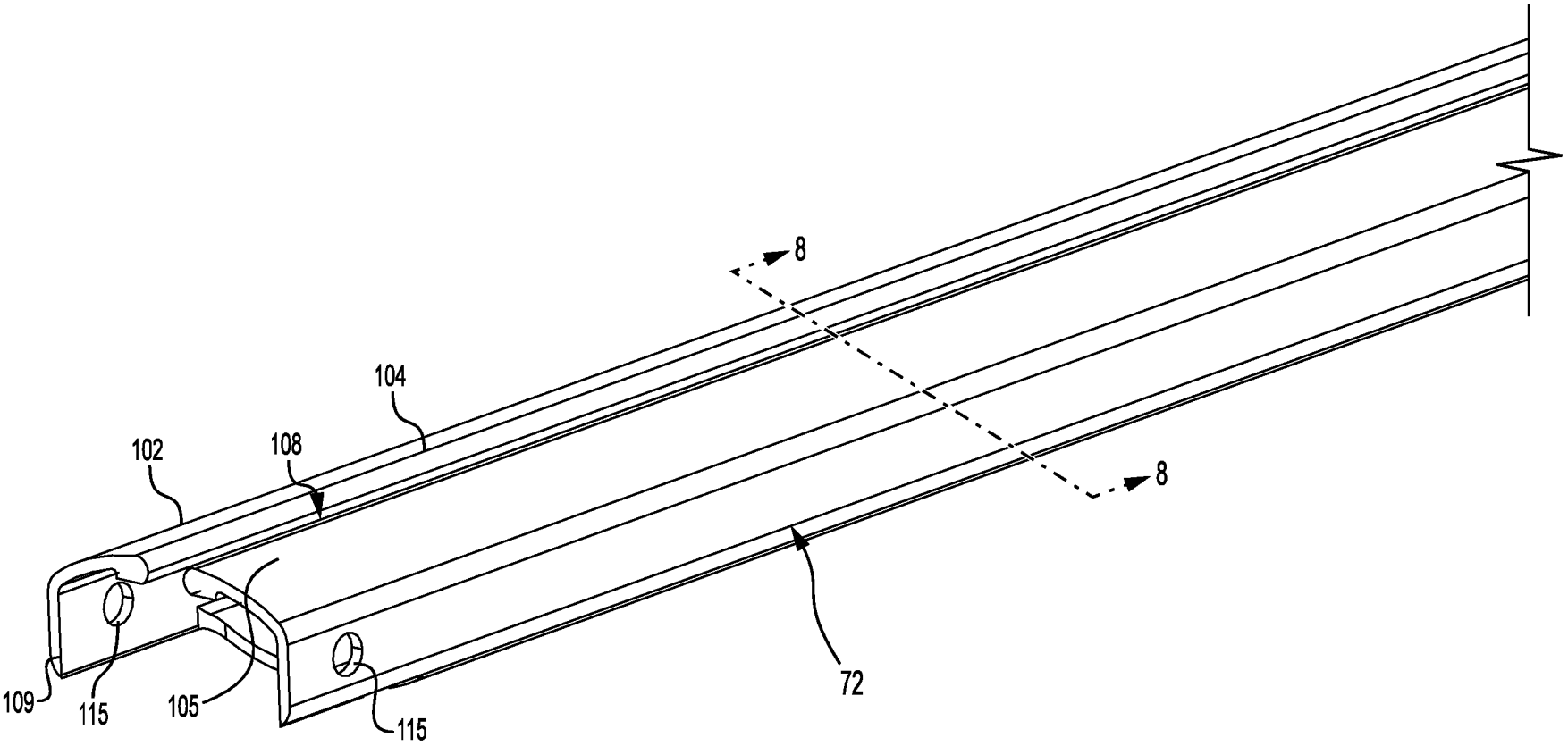
FIG. 7 is a perspective view, taken from a top, front, left side, of part of a lower rail of the left lateral portion of the barrier structure of FIG. 5.
Figure 9:
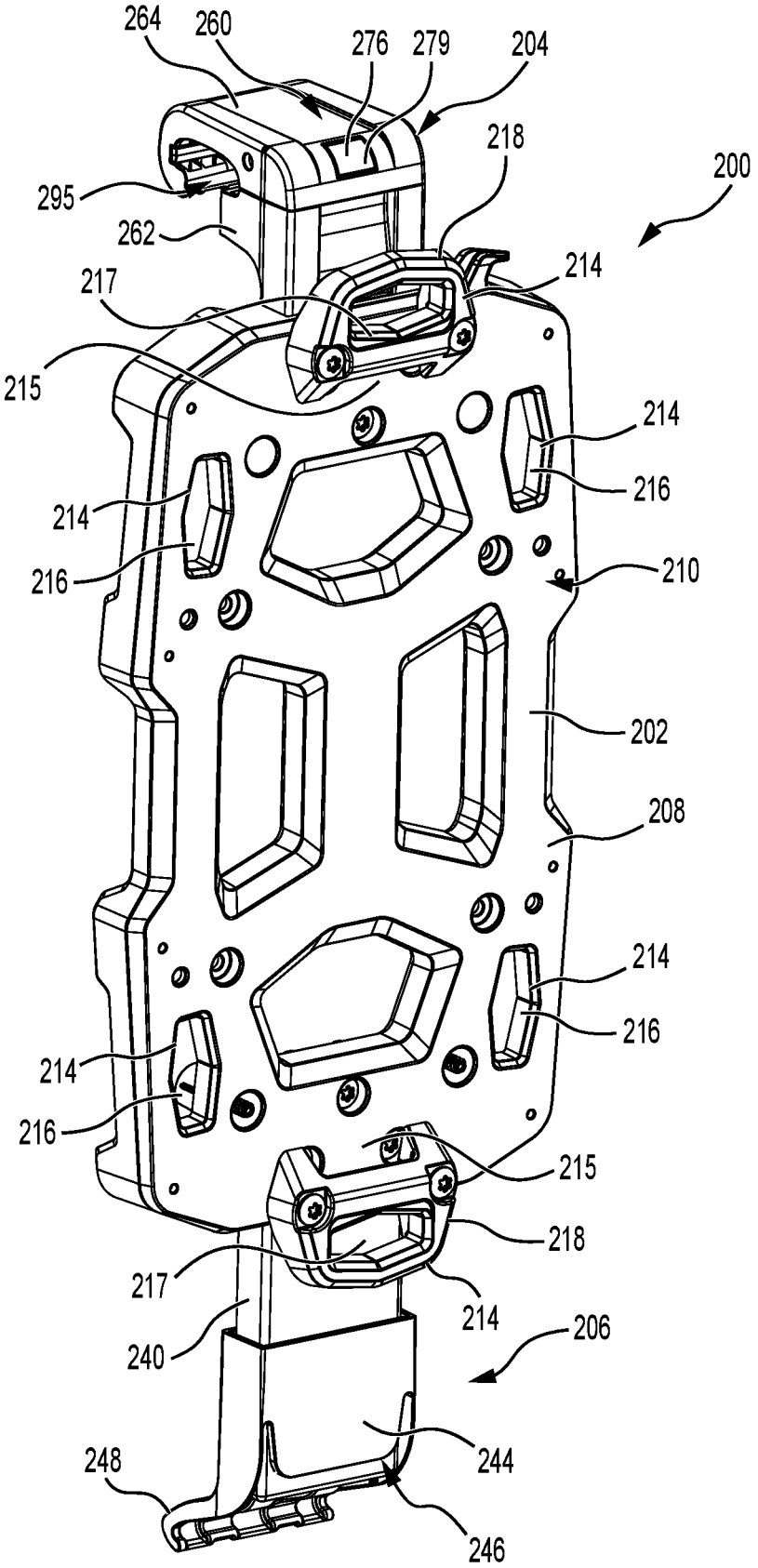
FIG. 9 is a perspective view, taken from a top, front, left side, of the barrier accessory device according to an embodiment of the present technology.

As can be seen in FIG. 7, the end portions 109 of the lower rail member 104 have two spaced opposite walls corresponding to the ends of the oval shaped cross-sectional profile shown in FIG. 9. Each of the two walls of the end portions 109 of the lower railing member 104 defines a respective opening 115 to fasten the lower railing member 104 to the lower frame connectors 106.

In this embodiment, the wall 64 is a pliable sheet wall including a pliable sheet panel 160. The pliable sheet panel 160 is made of a pliable material such that, when the pliable sheet panel 160 is not stretched and secured to the frame 62, the pliable sheet panel 160 can be folded by hand without undue force. In this embodiment, the pliable sheet panel 160 is made of fabric. With more specificity, in this embodiment, the pliable sheet panel 160 is made of woven polyester. Other types of fabrics are contemplated for use as the material of the pliable sheet panel 160. Moreover, it is contemplated that, in other embodiments, the pliable sheet panel 160 could be made of a different pliable material. For instance, in some embodiments, the pliable sheet panel 160 is made of a polymeric material such as polyvinyl chloride (PVC). Notably, the pliable sheet panels 160 of certain other portions 54, 58, 60 of the barrier structure 50 could be made of polymeric material. It is further contemplated that the barrier structure 50 be constructed differently, for example including a wall formed from molded fiberglass-reinforced composite material or the like.

The barrier accessory device 200 will now be described in detail with reference to FIGS. 9 to 16. The barrier accessory device 200 has an accessory connection base 202 configured for having one or more accessories 400 (FIGS. 30 to 34) removably connected thereto, and an upper rail connector 204 and a lower rail connector 206 configured to engage the upper rail 74 and the lower rail 102 of the barrier structure 50 of the boat 10 respectively, as shown in FIGS. 24 to 29.

The accessory connection base 202 has a base body 208 that is generally flat and has a left side 210 and a right side 212. The accessory connection base 202 has a plurality of accessory attachment features 214 configured to removably connect the accessories 400 thereto. Two of the accessory attachment features 214 are anchor fixtures 218 which are connected to the base body 208. In particular, in this embodiment, the two anchor fixtures 218 are connected to opposite end portions 220, 222 of the base body 202. In particular, an upper anchor fixture 218 is disposed at the upper end portion 220 of the base body 208 (which corresponds to the upper end portion of the accessory connection base 202) and a lower anchor fixture 218 is disposed at the lower end portion 222 of the base body 208 (which corresponds to the lower end portion of the accessory connection base 202). The lower end portion 222 is opposite the upper end portion 220.

Figure 33:
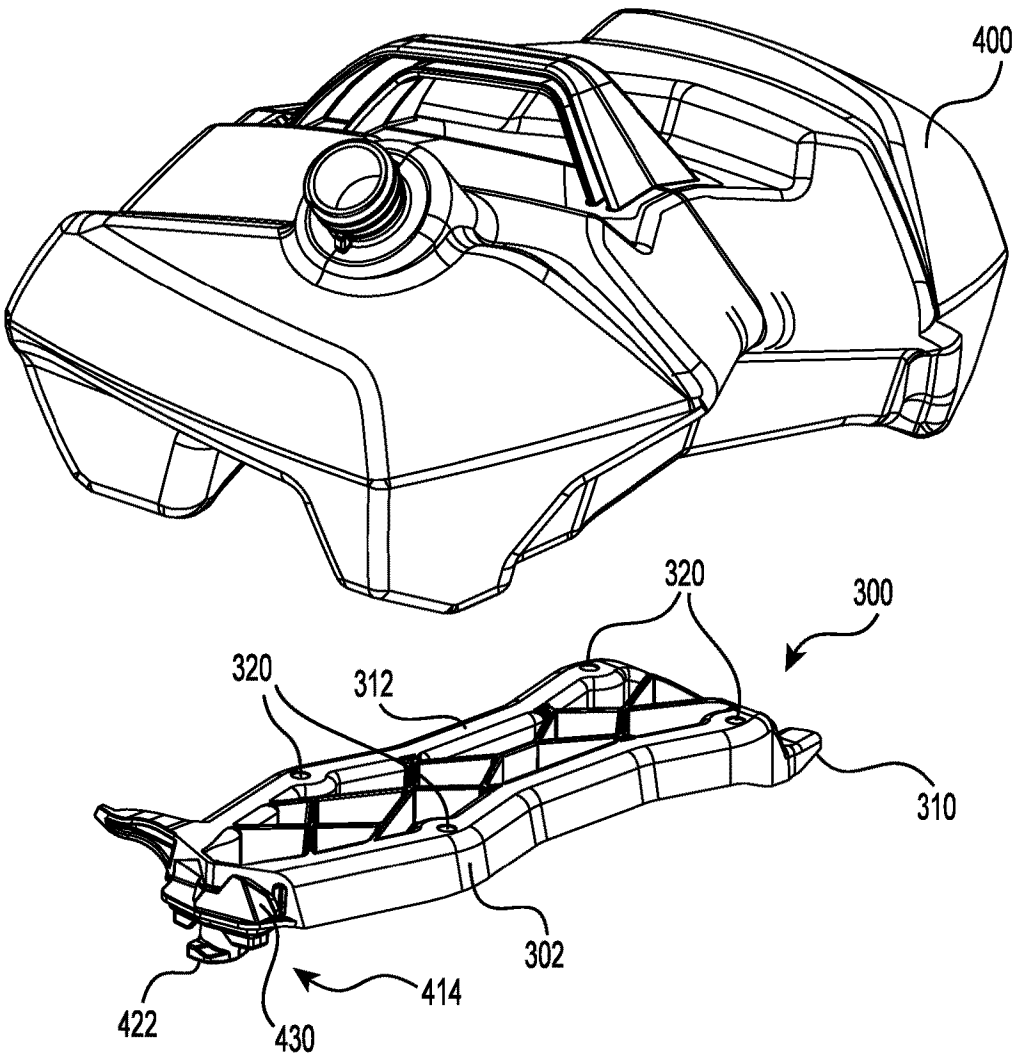
FIG. 33 is an exploded view of an accessory and an accessory base configured to be connected to the barrier accessory device.
Figure 34:
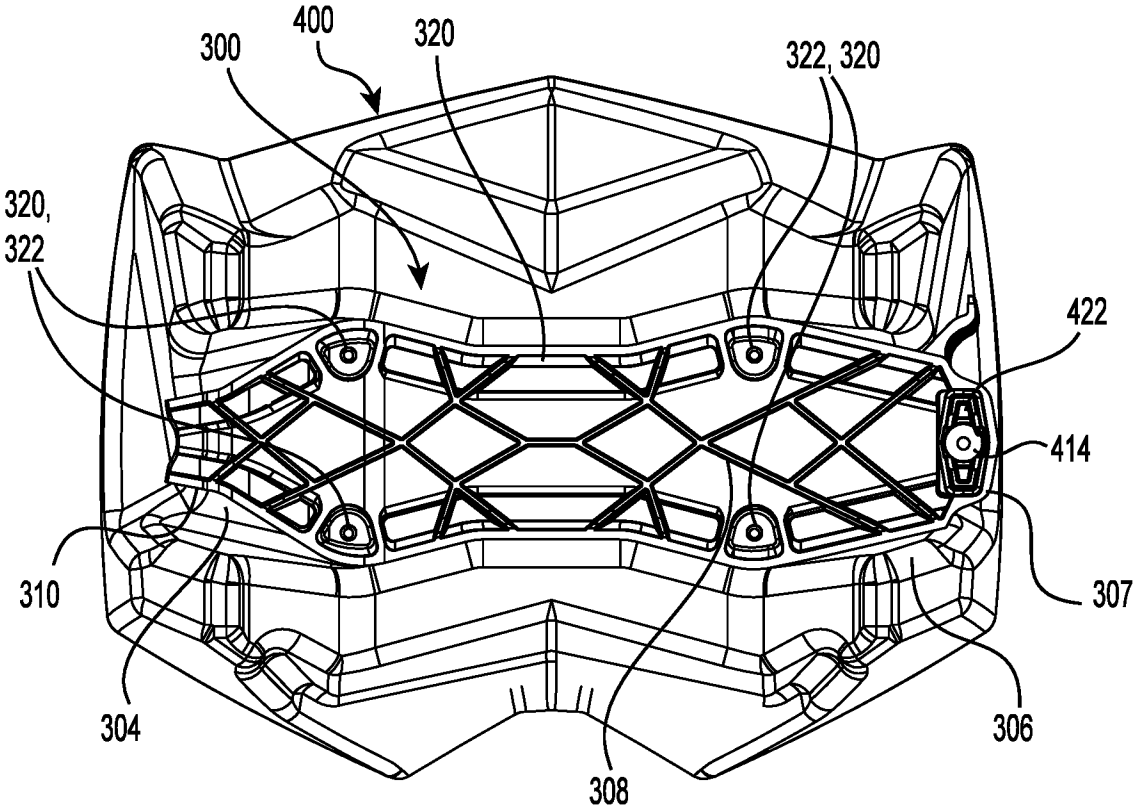
FIG. 34 is a bottom plan view of the accessory and the accessory base of FIG. 33.

The upper and lower anchor fixtures 218 are complementary with respective accessory attachment features that are connected to the accessory 400. Notably, with reference to FIGS. 33 and 34, the anchor fixtures 218 are configured to receive therein a tongue 310 and/or an anchor 414 connected to the accessory 400. In particular, as shown in FIGS. 33 and 34, which illustrated another embodiment of the jerry can 400, in this embodiment, an accessory base 300 is connected to a bottom surface of the accessory 400 (which is a jerry can in this embodiment), and the accessory base 300 comprises the tongue 310 and the anchor 414 on opposite sides 304, 307 thereof (FIG. 34). The accessory 400 is mounted on a side surface 312 of a frame 302 of the accessory base 300 and fastened thereto with fasteners 322 inserted through holes 320 defined by the frame 302. A more detailed description of the accessory base 300, as well as the tongue 310 and the anchor 414 thereof, can be found in U.S. Pat. No. 9,751,592, issued on Sep. 5, 2017, the entirety of which is incorporated herein by reference. The upper and lower anchor fixtures 218 and the anchor 414 will therefore be briefly described herein.

Figure 35:
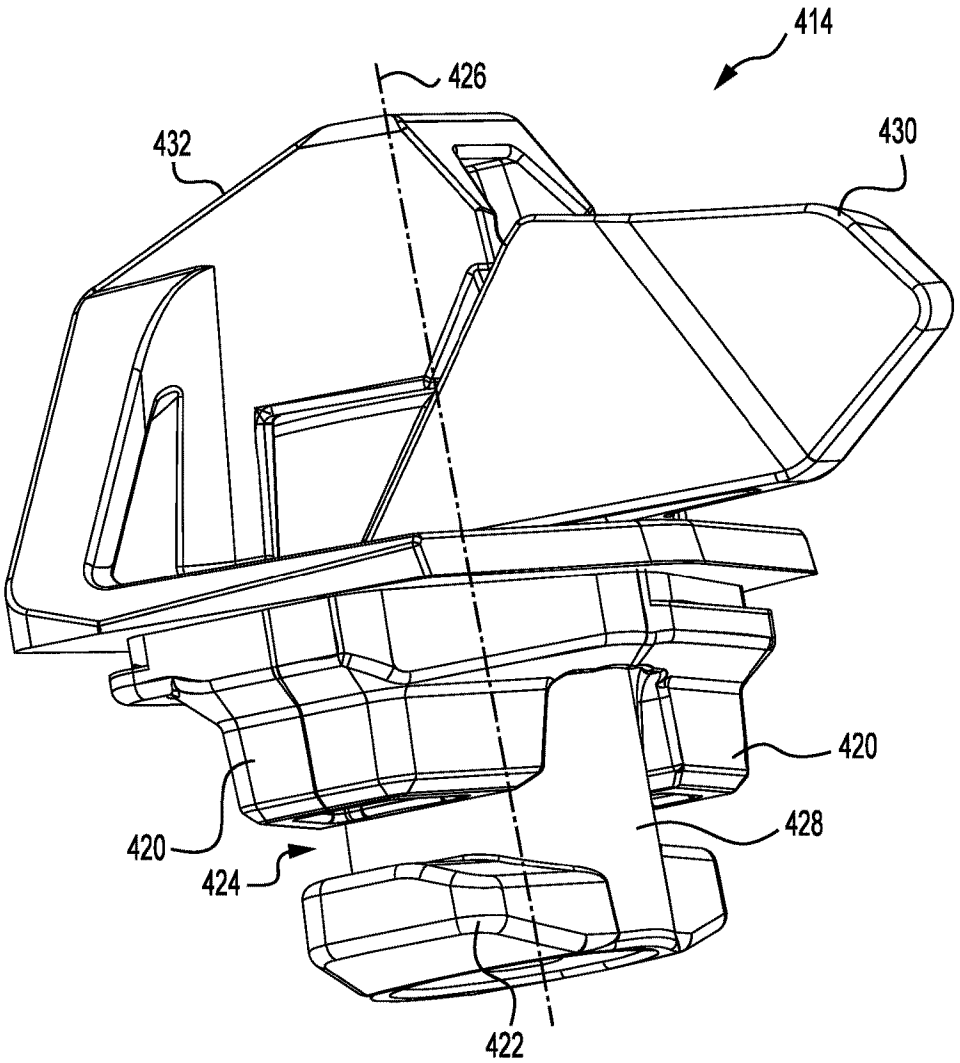
FIG. 35 is a perspective view of an anchor of the accessory base of FIG. 33.

With reference to FIG. 35, the anchor 414 has an anchor base 420 and an anchor lock 422 extending from the anchor base 420. The anchor lock 422 is pivotable relative to the anchor base 420 about an axis 426 between a locked position and an unlocked position. In the unlocked position, the anchor lock 422 is disposed parallel to the anchor base 420, and in the locked position, the anchor lock 422 is disposed perpendicular to the anchor base 420. The anchor lock 422 extends from a stem 428 extending along and defining the axis 426. A lever 430 is connected to a portion 432 of the anchor 414 that extends above the anchor base 420. The portion 432 is connected to the accessory 400 via the accessory base 300 (FIG. 33). The lever 430 is rotatable about the axis 426 and is connected to the stem 428 (and thereby operatively connected to the anchor lock 422) to move the anchor lock 422 between the locked and unlocked positions. The locked and unlocked positions of the anchor 414 correspond to the anchor lock 422 being rotated by 90 degrees relative to the anchor base 420, and to the lever 430 being correspondingly turned by 90 degrees. It is contemplated that the anchor lock 422 could be turned by more or less than 90 degrees to move the anchor lock 422 between the locked and unlocked positions. U.S. Pat. No. 9,751,592 describes the anchor 414 in greater detail. International Patent Application Publication No. WO 2012/002959 A1, published on 5 Jan. 2012, the entirety of which is incorporated herein by reference, also provides additional details regarding anchors similar in construction to the anchor 414. The anchor 414 will therefore not be described in greater detail herein.

As can be seen, the upper and lower anchor fixtures 218 can receive either one of the tongue 310 and the anchor 414 therein. In this embodiment, in order for the outlet of the jerry can 400 to be oriented upward, the tongue 310 is received in the lower anchor fixture 218 while the anchor 414 is received in the upper anchor fixture 218. Each anchor fixture 218 defines two apertures 215, 217 which are configured to receive the tongue 310 and the anchor 414 respectively to secure the accessory 400 to the accessory connection base 202. As such, the apertures 215, 217 are shaped to receive the respective ones of the tongue 310 and the anchor 414. Notably, in this embodiment, the aperture 217 has a generally elongated hexagonal shape to receive the elongated hexagonal shape of the anchor lock 422 of the anchor 414. A more detailed description of the anchor fixtures 218 can be found in U.S. Pat. No. 9,751,592.

Returning now to FIG. 9, some of the accessory attachment features 214 of the accessory connection base 202 are openings 216 defined by the flat base body 208. In this embodiment, four openings 216 are provided and they are configured to receive therein a corresponding anchor 414 (FIG. 35) that is connected to a corresponding accessory 400. For instance, this may be used to attach smaller accessories 400 to the accessory connection base 202. The openings 216 have a same generally elongated hexagonal shape as the anchor lock 422 of the anchor 414.

Figure 11:
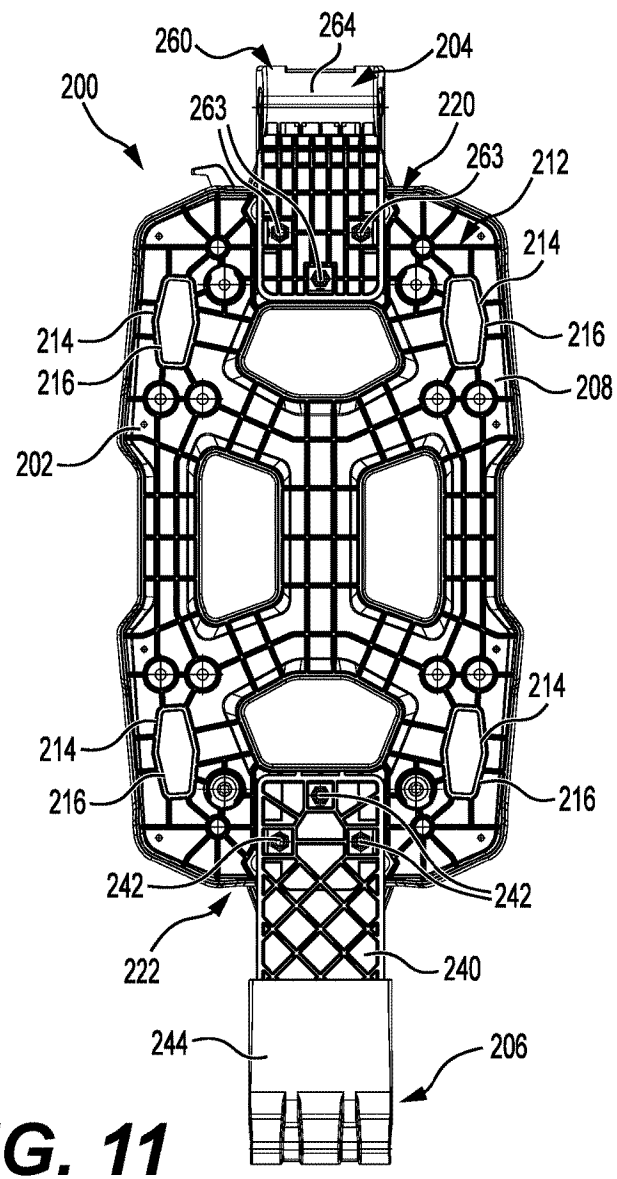
FIG. 11 is a right side elevation view of the barrier accessory device of FIG. 9.
Figure 10:
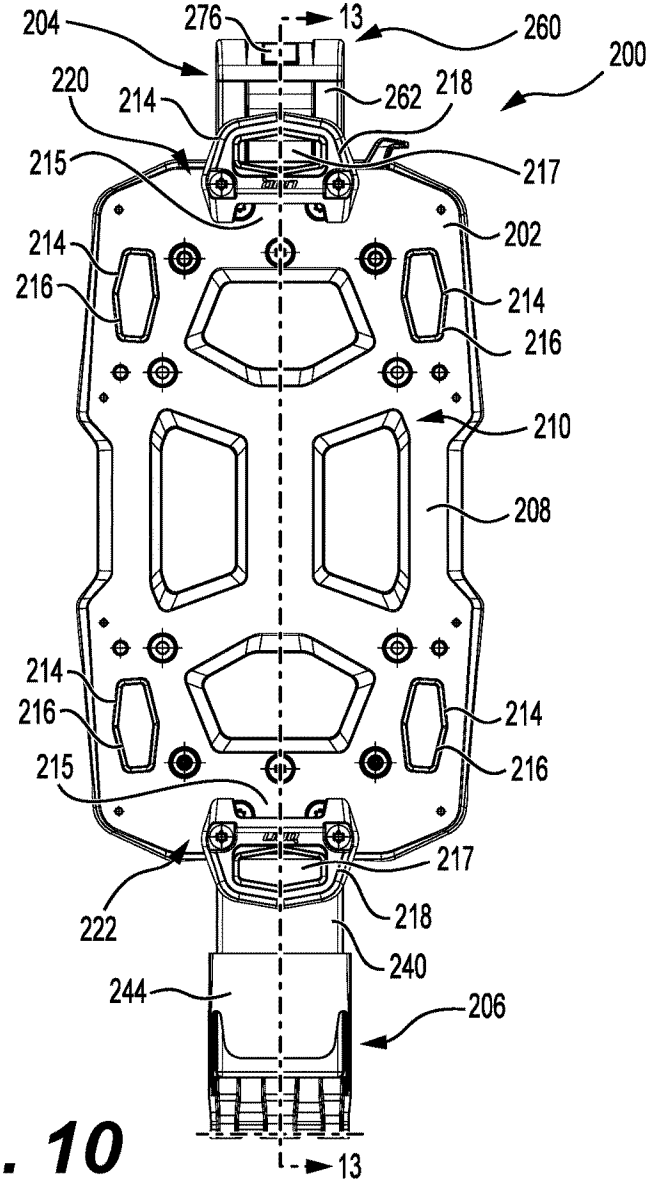
FIG. 10 is a left side elevation view of the barrier accessory device of FIG. 9.
Figure 13:
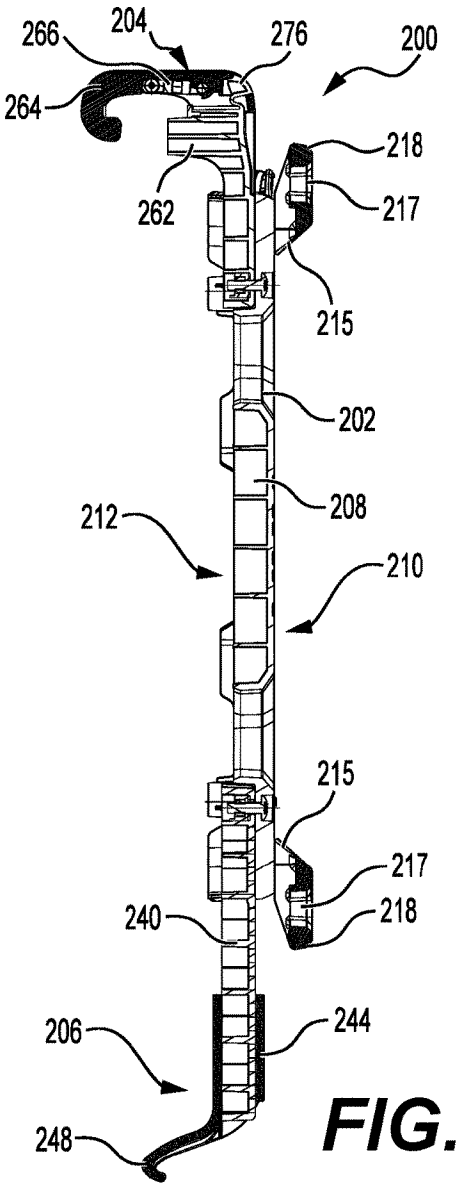
FIG. 13 is a cross-sectional view of the barrier accessory device of FIG. 9, taken along line 13-13 in FIG. 10.
Figure 12:
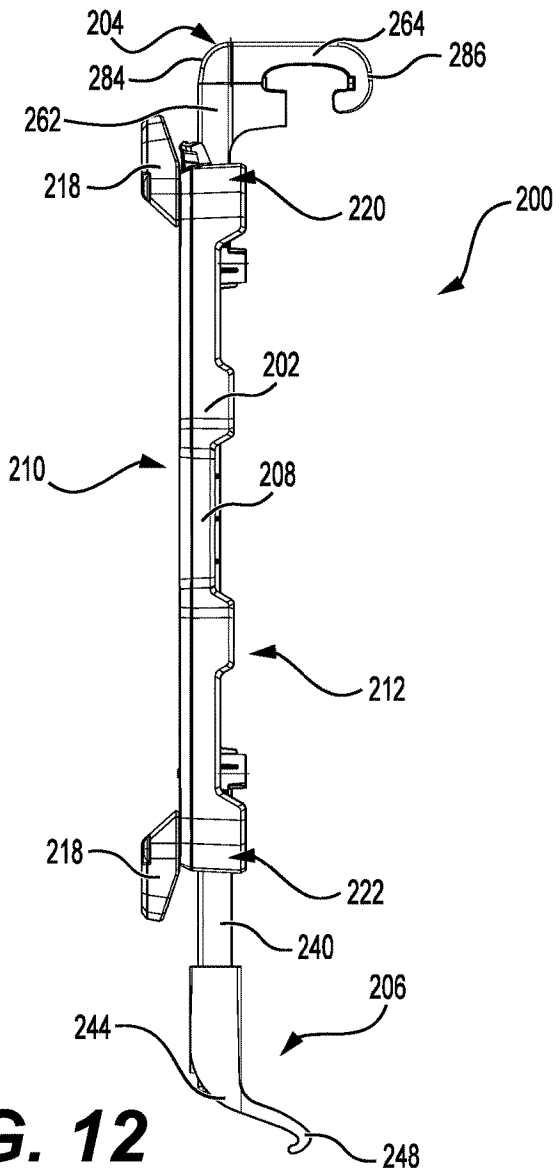
FIG. 12 is a rear elevation view of the barrier accessory device of FIG. 9.
Figure 15:
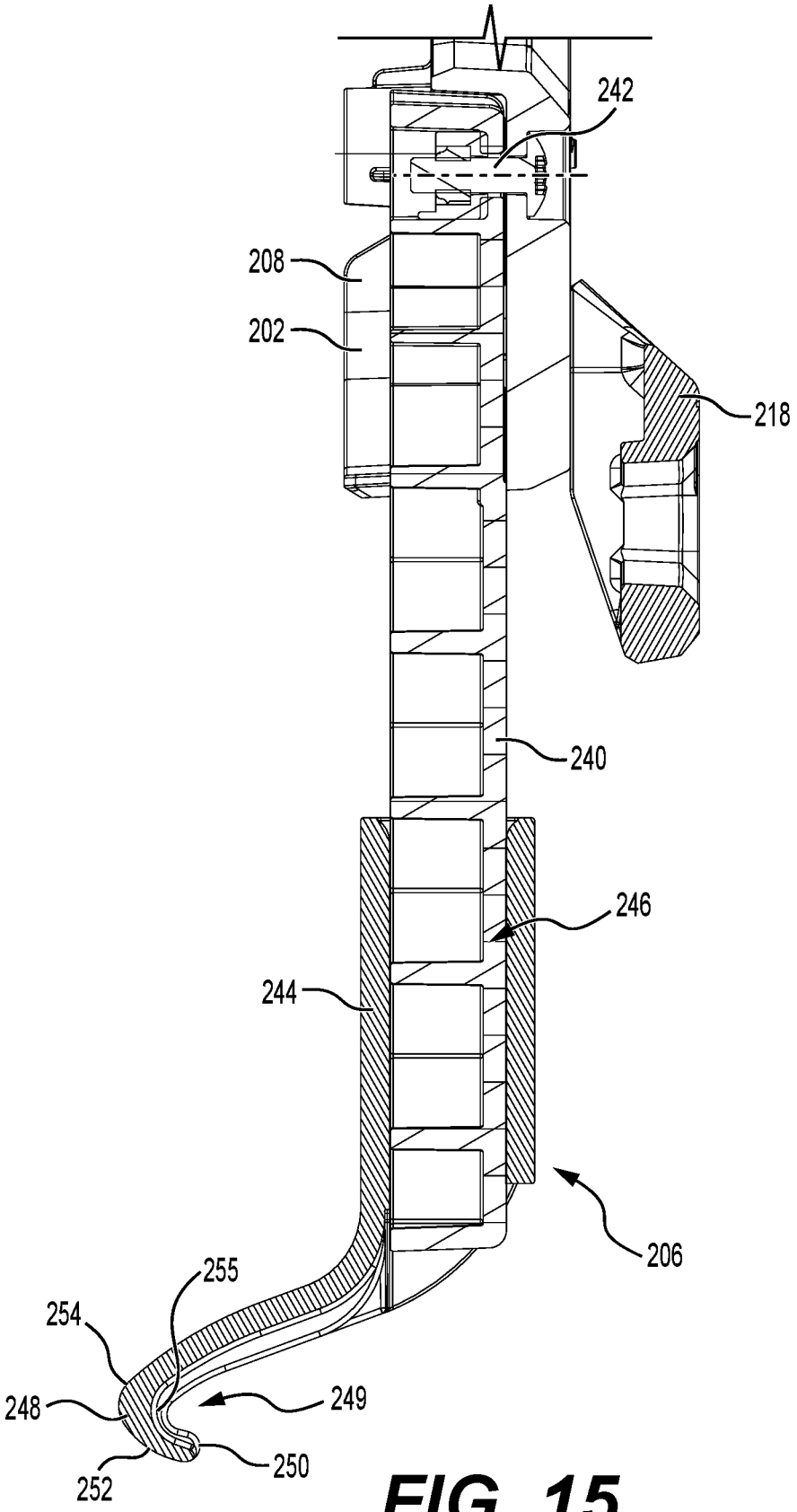
FIG. 15 is a detailed view of another part of the cross-section of FIG. 13, showing a lower rail connector of the barrier accessory device.

With reference now to FIGS. 12, 13 and 15, the lower rail connector 206 is connected to the accessory connection base 202 at the lower end portion thereof. Notably, the lower rail connector 206 has a fixed member 240 that is connected to the accessory connection base 202 via three fasteners 242 (FIGS. 11, 15), and a movable member 244 (FIG. 15) that is operatively connected to the fixed member 240 and movable relative thereto. In particular, the fixed member 240 has a generally rectangular cross-sectional profile and is received in part within a recess 246 defined by the movable member 244. The recess 246 has a rectangular shape corresponding to the shape of the rectangular cross-sectional profile of the fixed member 240. In particular, the recess 246 is dimensioned such that the fixed member 240 is in a running or sliding fit with the recess 246. As such, the movable member 244 is slidable along at least a portion of a length of the fixed member 240 via the recess 246 such that the position of the lower rail connector 206 is adjustable relative to the accessory connection base 202. This allows a user to modify the distance between upper and lower rail connectors 204, 206 which can be useful to adapt the barrier accessory device 200 to different positions along the barrier structure 50 and/or to different boats where the distance between the upper and lower rails 74, 102 thereof may be different. In order to keep the movable member 244 from disengaging the fixed member 240, the movable member 244 has an inner shoulder (not shown) that, at a lowermost position of the movable member 244 relative to the fixed member 240, abuts a lip (not shown) at the lowermost end of the fixed member 240.

It is contemplated that, in alternative embodiments, the position of the upper rail connector 204 relative to the accessory connection base 202 could be adjustable instead of the lower rail connector 206. In other embodiments, both positions of the upper and lower rail connector 204, 206 relative to the accessory connection base 202 could be adjustable.

As will be explained in detail below, the movable member 244 is configured to engage the slot 208 defined by the lower rail 102 of the barrier structure 50. The movable member 244 may thus alternatively be referred to as a slot-engaging member 244. In particular, the slot-engaging member 244 has a tip portion 248 at its end furthest from the fixed member 240 that is configured to engage the slot 208 of the lower rail 102. The tip portion 248 is hook-shaped to fix the slot-engaging member 244 within the slot 108 of the lower rail 102. In particular, the tip portion 248 has an interior curved surface 254 that defines a cavity 249 that forms the hook-shape of the tip portion 248. The tip portion 248 has a tip 250 and a cam surface 252 extending from the tip 250. The cam surface 252 defines part of the exterior section of the tip portion 248. The cam surface 252 is configured for securing the tip portion 248 to the corresponding lower rail 102. As will be described in greater detail further below, the tip portion 248 allows the slot-engaging member 244 to be secured to the lower rail 102.

Figure 14:
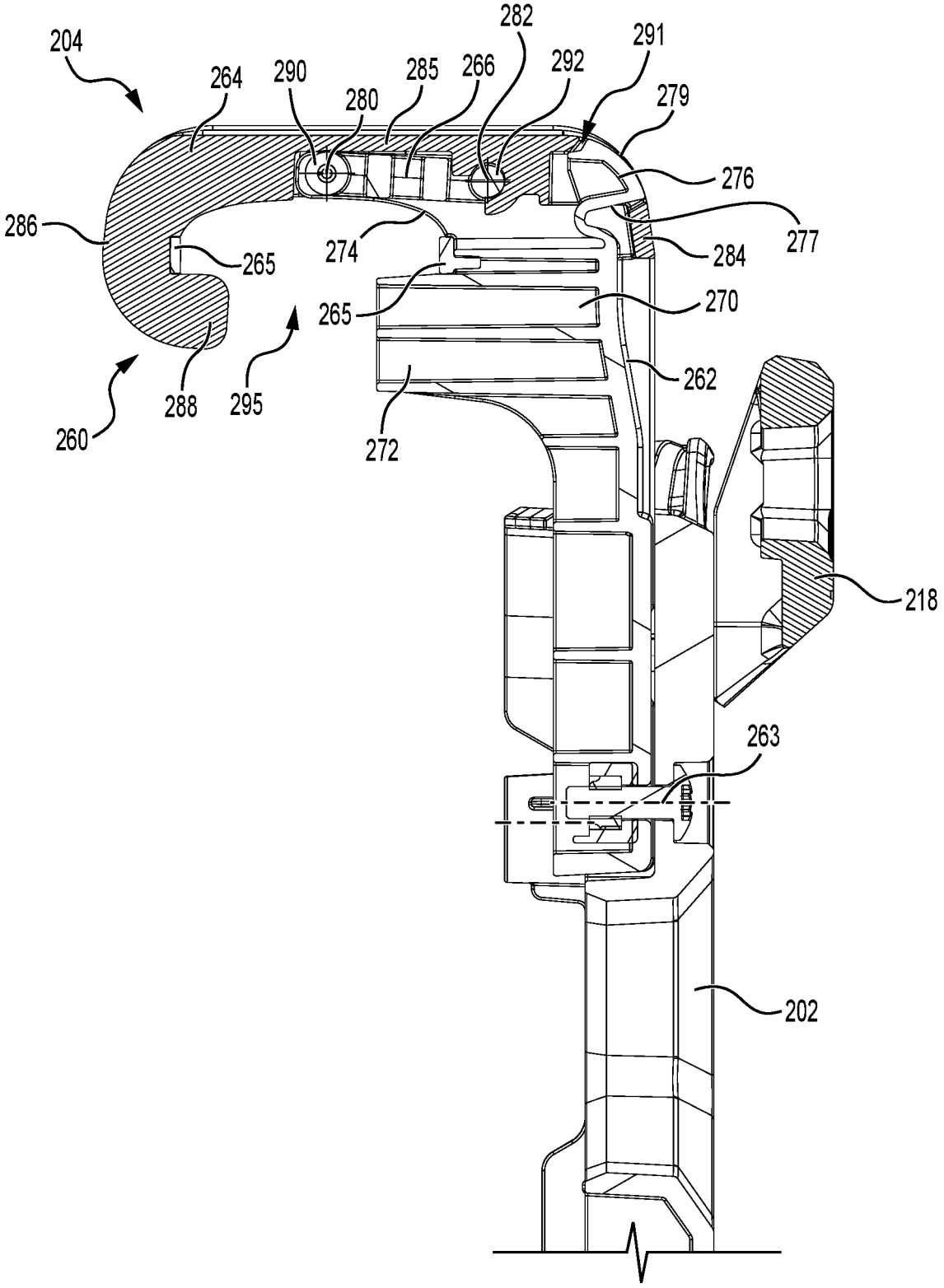
FIG. 14 is a detailed view of the cross-section of FIG. 13, showing an upper rail connector of the barrier accessory device.

Turning now to FIG. 14, the upper rail connector 204 is connected to the accessory connection base 202 at the upper end portion thereof. The upper rail connector 204 includes a locking assembly 260 configured to be selectively locked onto the upper rail 74 of the barrier structure 50. That is, as will be explained in detail further below, the locking assembly 260 is operable by the user to lock the barrier accessory device 200 to the upper rail 74. The locking assembly 260 includes a fixed member 262 connected to the accessory connection base 202, a locking member 264 movable relative to the fixed member 262, and a pivot member 266 operatively connecting the locking member 264 to the fixed member 262.

The fixed member 262 is fastened to the upper end portion 220 of the base body 208 by three fasteners 263 (FIGS. 11, 14). The fixed member 262 extends from the upper end portion 220 of the base body 208 in a direction away from the lower end portion 222 (i.e., upwardly in the frame of reference of the barrier accessory device 200). In this embodiment, the fixed member 262 is generally F-shaped, namely having a main portion 270 (extending generally vertically when the barrier accessory device 200 is locked onto the upper rail 74) and two protruding portions 272, 274 extending from the main portion 270 generally transversally thereto. The protruding portions 272, 274 include a lower protruding portion 272 and an upper protruding portion 274 extending generally parallel to one another and toward a same direction from the main portion 270. A distance between the upper protruding portion 274 and the upper end portion of the accessory connection base 202 is greater than a distance between the lower protruding portion 272 and the upper end portion of the accessory connection base 202. As will be discussed below, the lower protruding portion 272 is configured to be received in a recess defined by the upper rail 74. It is contemplated that, in alternative embodiments, the lower protruding portion 272 could be omitted. The fixed member 262 may therefore not be F-shaped, for instance being L-shaped instead.

As best shown in FIG. 14, in this embodiment, the fixed member 262 also has a latch 276 extending upward from the upper end of the main portion 270. The latch 276 is dimensioned to be narrower than the main portion 270. While the latch 276 is integrally made with a remainder of the fixed member 262, a connection between the latch 276 and the main portion 270 (i.e., the material connecting the latch 276 to the main portion 270) is dimensioned so that the latch 276 is elastically movable relative to the main portion 270. That is, the latch 276 can be moved relative to the main portion 270 and elastically returns to its original position. The latch 276 has a lower latching surface 277 extending on a lower side of the latch 276, and a curved outer surface 279. As will be described further below, the latch 276 allows the locking member 264 to be retained by the fixed member 262.

The locking member 264 is movable relative to the fixed member 262 between a locked position for the locking assembly 260 to lock onto the upper rail 74 and an unlocked position for the locking assembly 260 to release the upper rail 74. In FIGS. 9 to 14 and 16, the locking member 264 is shown in its locked position. The unlocked position of the locking member 264 is illustrated in FIGS. 20 to 22B. The locking member 264 is pivotable between the locked and unlocked positions about two pivot axes 280, 282 (FIG. 14) which are defined by pivots formed between the fixed member 262 and the pivot member 266 and between the locking member 264 and the pivot member 266. The pivot axes 280, 282 are generally parallel to one another. The manner in which the locking member 264 pivots between the locked and unlocked positions will be described in more detail further below.

As shown in FIGS. 12 to 14, the locking member 264 has an outer end portion 284, an inner end portion 286 and a middle portion 285 extending therebetween. In the locked position of the locking member 264, the outer end portion 284 is closer to the accessory connection base 202 than the inner end portion 286 (i.e., the distance between the outer end portion 284 and the accessory connection base 202 is less than the distance between the inner end portion 286 and the accessory connection base 202). As can be seen, in this embodiment, the inner end portion 286 is generally hook-shaped and therefore may be referred to as a hook portion 286 of the locking member 264. The hook portion 286 has a hook tip 288 that, in the locked position of the locking member 264, is vertically offset from the middle portion 285. Notably, in this embodiment, in the locked position of the locking member 264, the hook tip 288 is disposed vertically lower than the middle portion 285. As will be described in detail further below, the hook portion 286 of the locking member 264 is configured to extend into a recess of the upper rail 74.

As shown in FIG. 14, the locking member 264 defines a latch-receiving recess 291 disposed at the outer end portion 284 configured to receive the latch 276 of the fixed member 262 when the locking member 264 is in the locked position. In the unlocked position of the locking member 264, the latch 276 is removed from the latch-receiving recess 291.

The latch-receiving recess 291 is thus shaped and dimensioned to receive and retain the latch 276 therein. Notably, in the locked position of the locking member 264, the lower latching surface 277 of the latch 276 interacts with a surface defining the latch-receiving recess 291 to prevent the locking member 264 from moving to the unlocked position. Moreover, as can be seen in FIG. 9, when the latch 276 is received in the latch-receiving recess 291, the outer surface 279 of the latch 276 is generally contiguous with a surface of the locking member 264.

It is contemplated that, in other embodiments, the fixed member 262 could define the latch-receiving recess while the locking member 264 comprises the latch 276. It is further contemplated that the latch 276 could be omitted.

Figure 16:
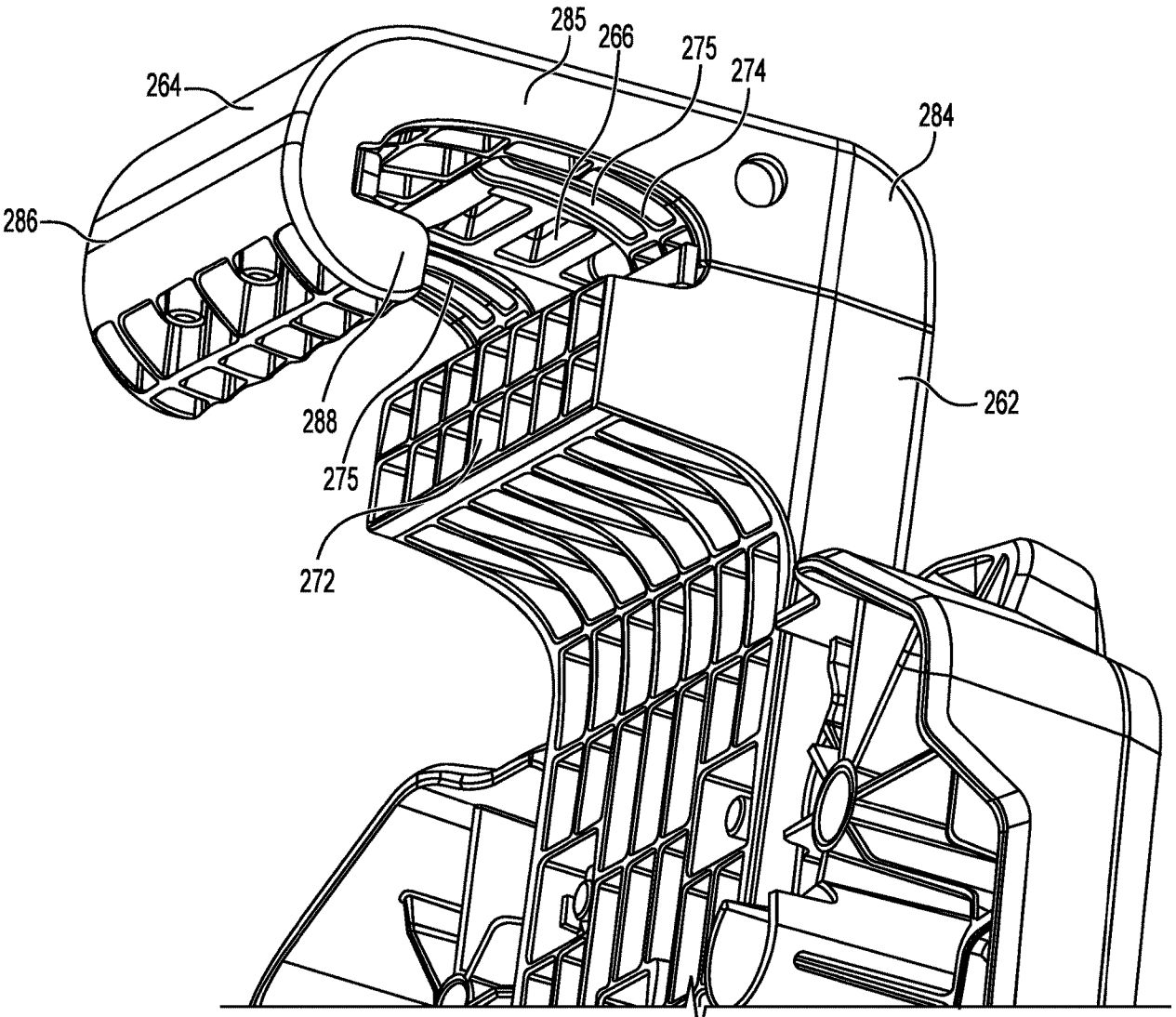
FIG. 16 is a perspective view, taken from a bottom, front, right side, of the upper rail connector of FIG. 14.
Figure 22B:
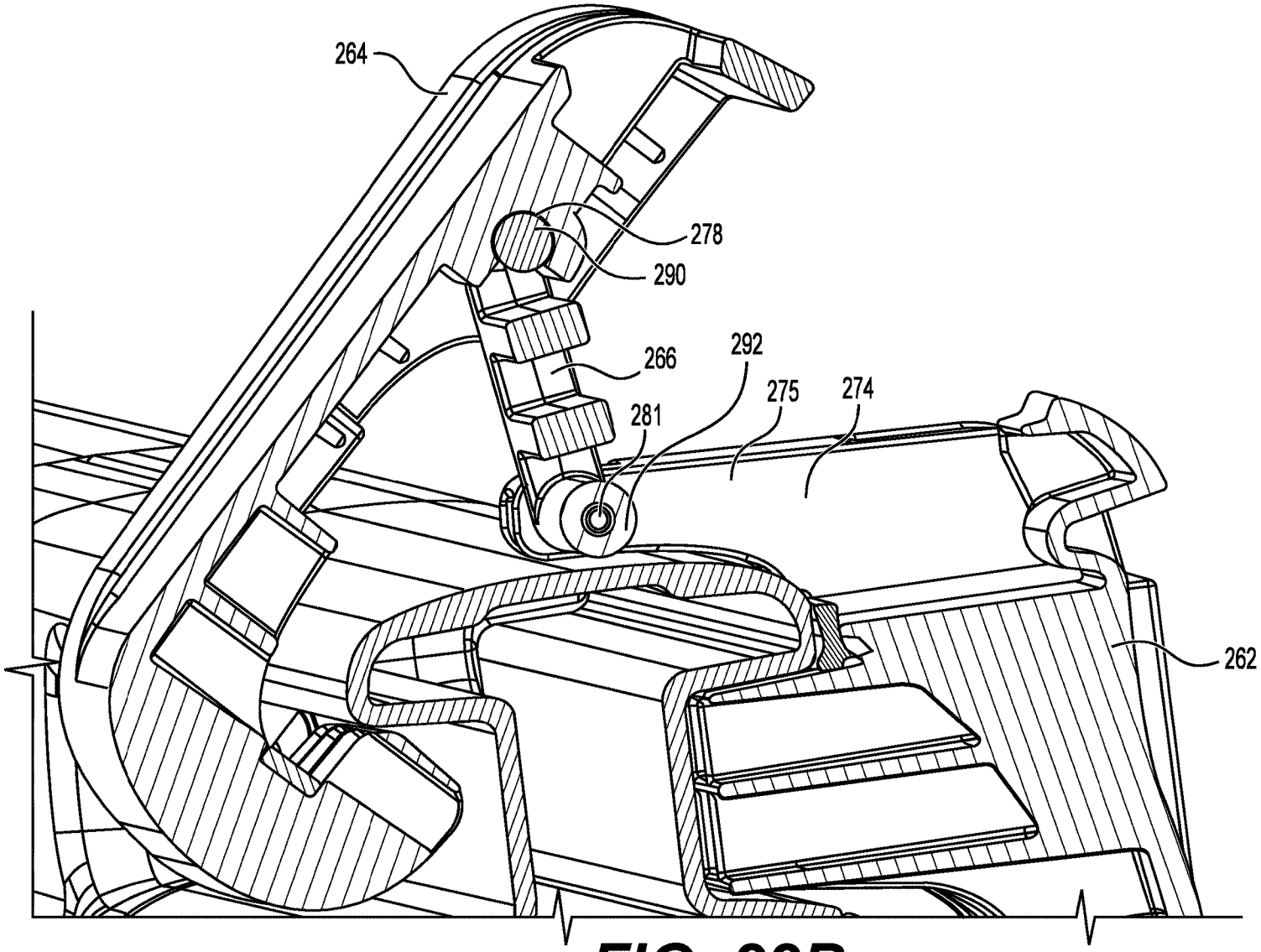
FIG. 22B is a perspective view, taken from a top, front, right side, of a cross-section of the upper rail connector of the barrier accessory device, showing the upper rail connector in the unlocked position.

As shown in FIGS. 14 and 16, the pivot member 266 extends between two opposite pivot features 290, 292 thereof which define the pivot axes 280, 282 respectively. In particular, the pivot member 266 is pivotally connected to the fixed member 262 via the pivot feature 290 and to the locking member 264 via the pivot feature 292. In this embodiment, the pivot features 290, 292 are respective shafts of the pivot member 266. As best seen in FIG. 22B, the shaft 290 is received in a corresponding recess 278 of the locking member 264. The shaft 292 extends between two prongs 275 (best shown in FIG. 16) of the upper protruding portion 274 of the fixed member 262. A pin 281 extends within the shaft 292 and is rotatably connected to each of the prongs 275. As such, the shaft 292 is rotatably connected to the fixed member 262 via the pin 281. As shown in FIG. 14, in the locked position of the locking member 264, the pivot member 266 is received in a recess defined by the middle portion 285 of the locking member 264, on an underside thereof. Moreover, as shown in FIG. 16, in the locked position of the locking member 264, the pivot member 266 is disposed between the two prongs 275 of the upper protruding portion 274 of the fixed member 262. The pivot member 266 is thus hidden from view when the locking member 264 is in the locked position, particularly when the locking assembly 260 is locked onto the upper rail 74 (FIGS. 24 to 29).

The manner in which the barrier accessory device 200 is attached to the barrier structure 50, notably one of the lateral portions 56 thereof in this embodiment, will now be described with reference to FIGS. 17 to 29.

Figure 17:
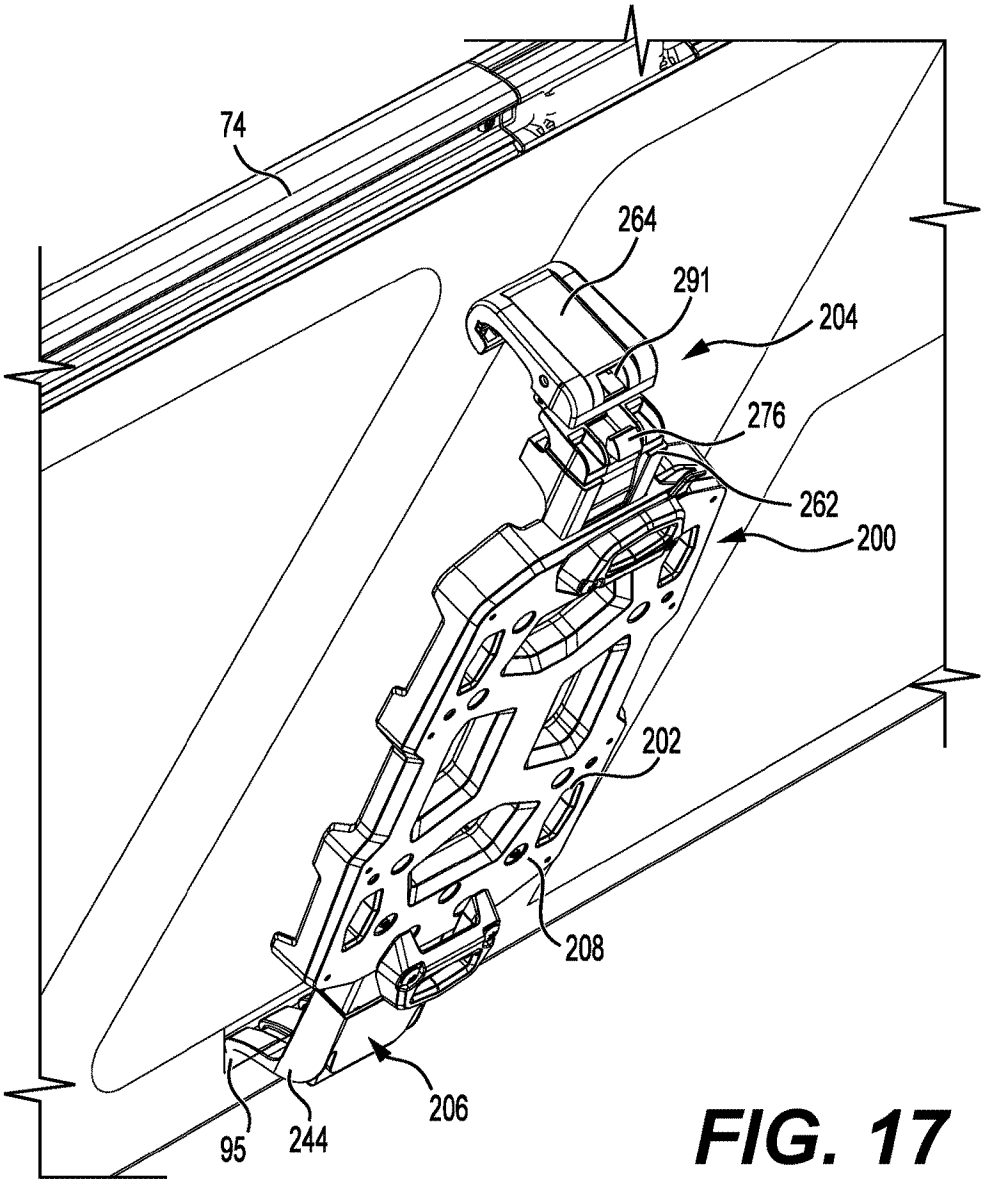
FIG. 17 is a perspective view, taken from a top, front, left side, of part of the left lateral portion of the barrier structure and the barrier accessory device, showing the lower rail connector engaged with the lower rail of the barrier structure.
Figure 18:
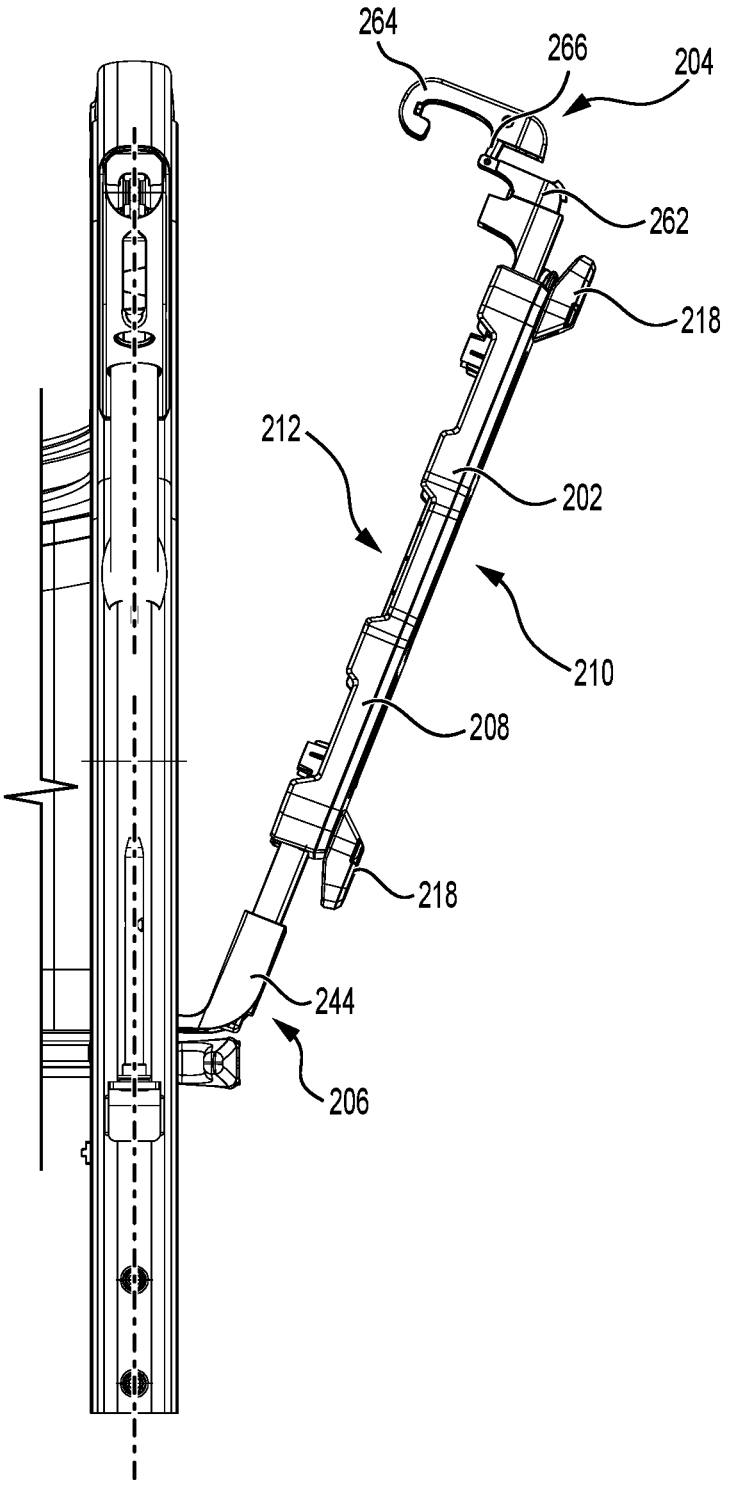
FIG. 18 is a front elevation view of part of the left lateral portion of the barrier structure and the barrier accessory device showing the lower rail connector engaged with the lower rail of the barrier structure.
Figure 19:
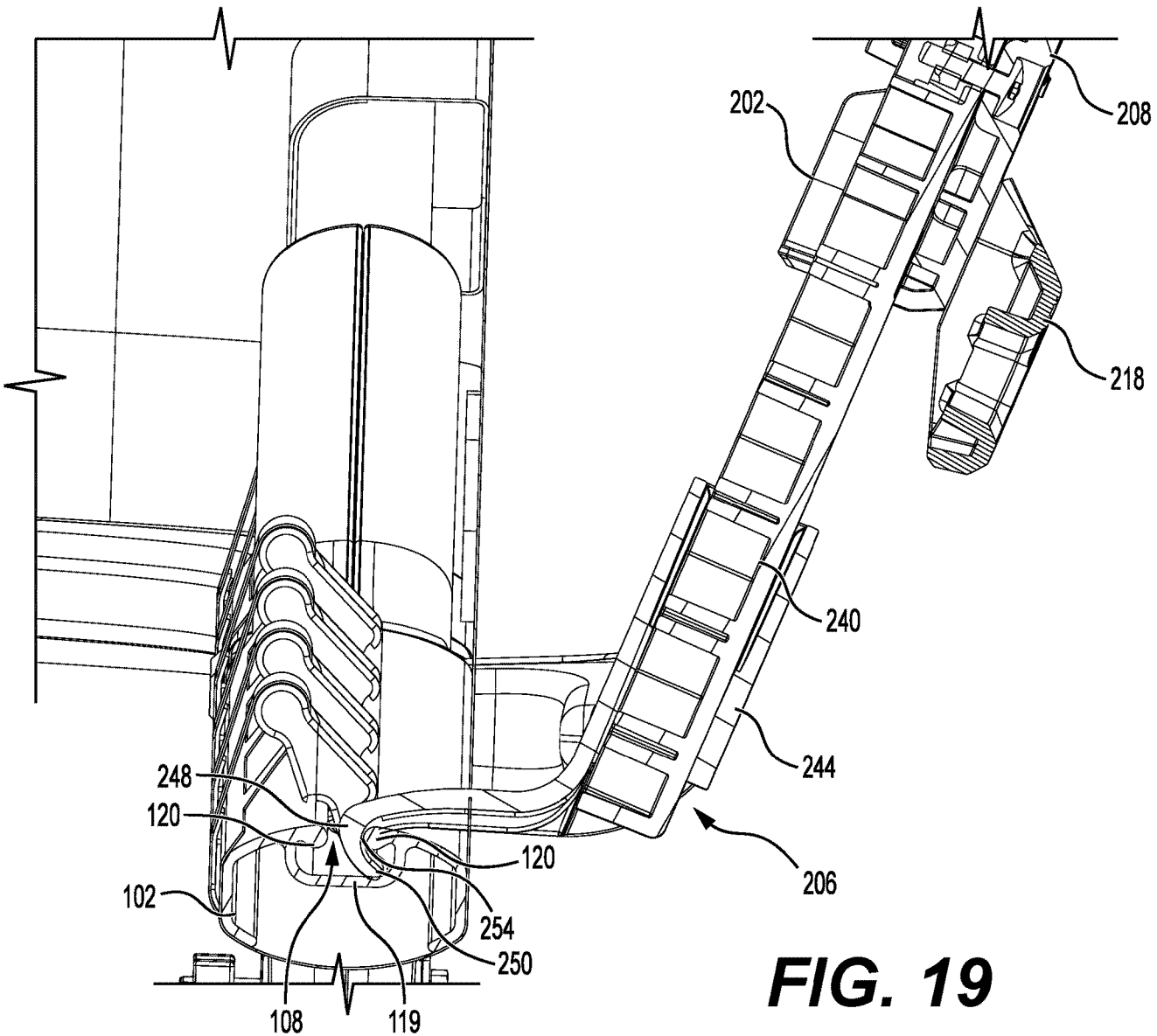
FIG. 19 is a cross-sectional view of the lower rail connector of the barrier accessory device of FIG. 17, showing the lower rail connector engaged with the lower rail of the barrier structure.
Figure 20:
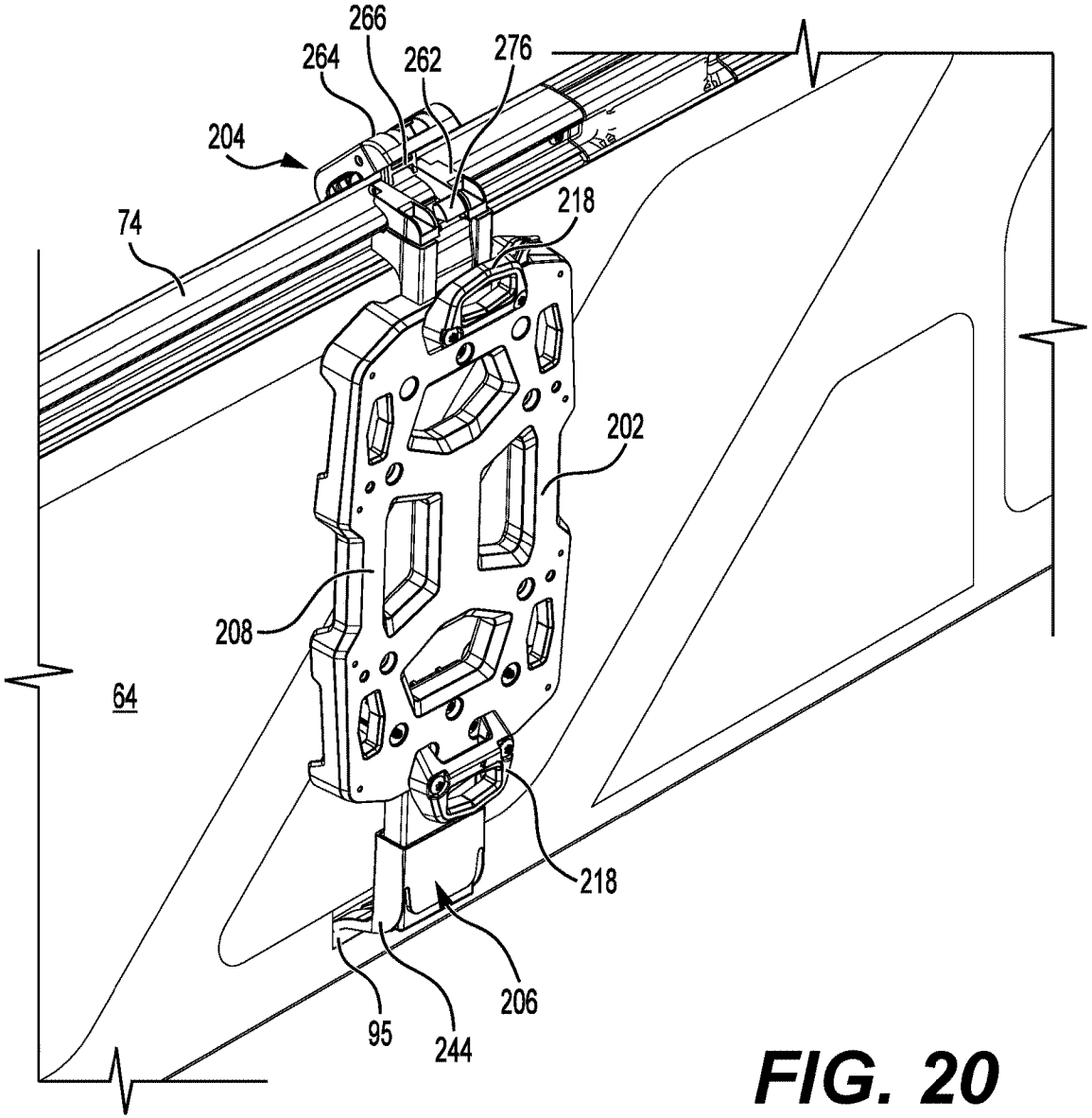
FIG. 20 is a perspective view, taken from a top, front, left side, of part of the left lateral portion of the barrier structure and the barrier accessory device, showing the upper rail connector engaged with the upper rail of the barrier structure in an unlocked position.
Figure 21:
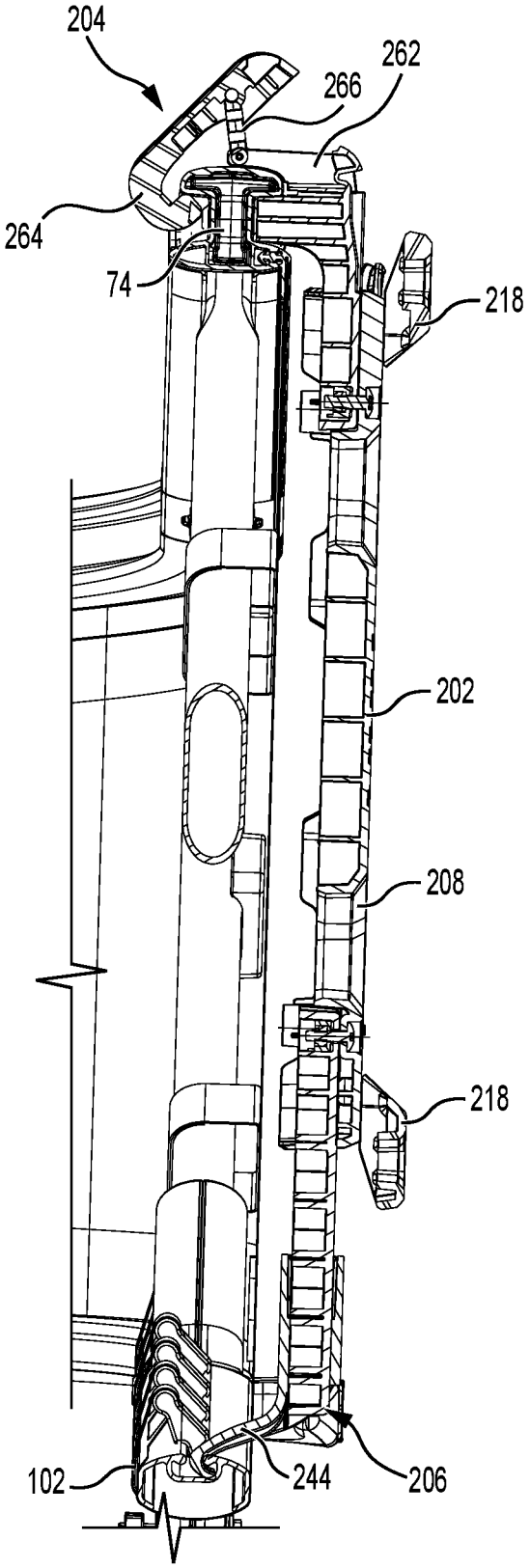
FIG. 21 is a cross-sectional view of part of the left lateral portion of the barrier structure and the barrier accessory device, showing the upper rail connector engaged with the upper rail of the barrier structure in an unlocked position.

First, as shown in FIGS. 17 to 19, the lower rail connector 206 is engaged with the lower rail 102. Notably, the barrier accessory device 200 is inclined and part of the lower rail connector 206, namely the slot-engaging member 244 thereof, is inserted through one of a plurality of openings 95 (also shown in FIGS. 24 and 25) defined by the wall 64 of the barrier structure 50. The tip portion 248 of the slot-engaging member 244 is then inserted into the upwardly-facing slot 108 of the lower rail 102. In particular, as best shown in FIG. 19, the tip 250 is inserted into the slot 108 such that the interior curved surface 254 of the tip portion 248 comes into contact with the outermost one of the upper ends 120 of the lower rail 102 and the tip 250 contacts the interior wall 119.

Figure 23:
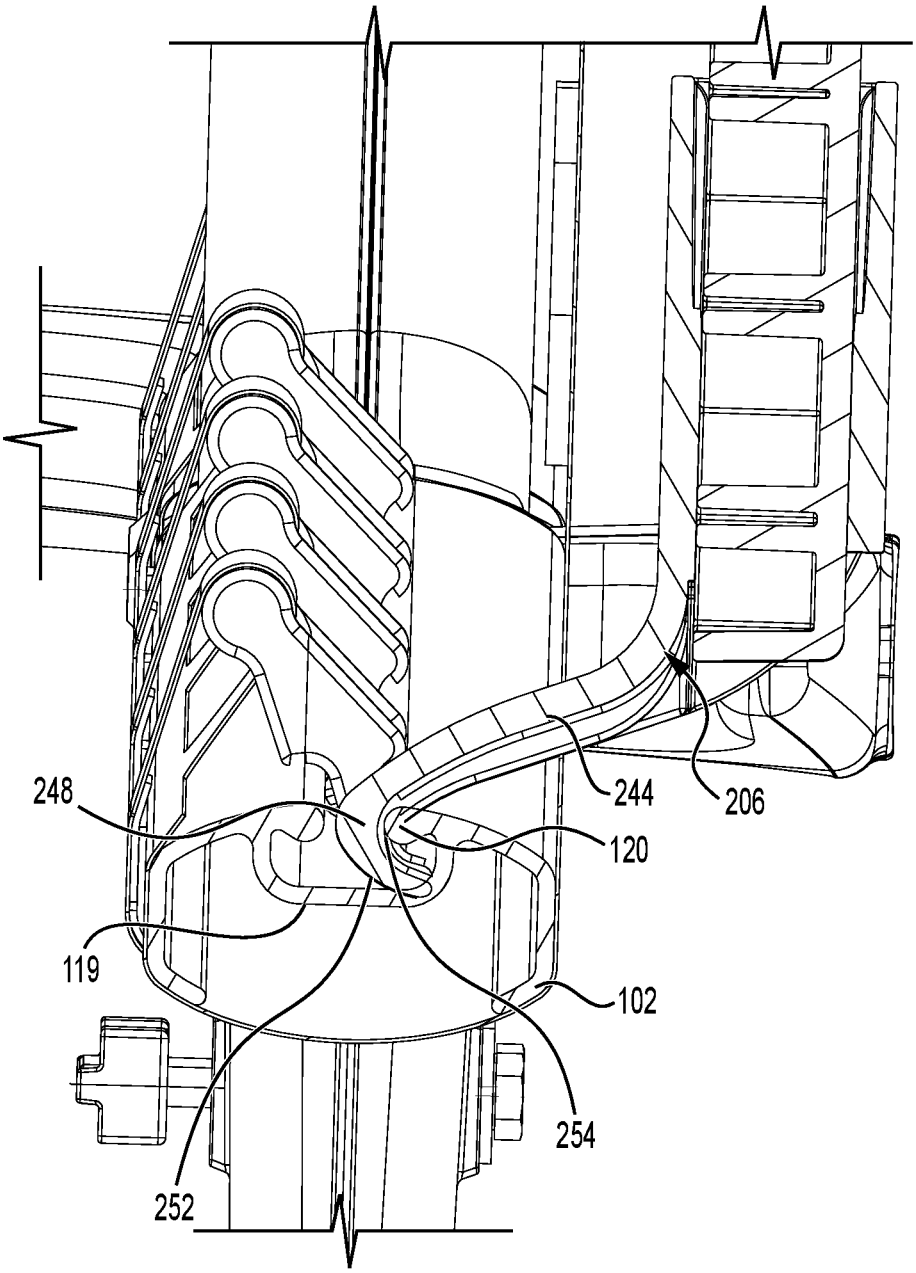
FIG. 23 is a detailed view of part of FIG. 21, showing the lower rail connector of the barrier accessory device.

Next, with reference to FIGS. 20 to 23, the barrier accessory device 200 is pivoted about the lower rail connector 206 to an upright position, with the upper rail connector 204 engaging the upper rail 72. Notably, as shown in FIG. 23, when the barrier accessory device 200 is placed in its upright position, the cam surface 252 of the tip portion 248 slides against the interior wall 119 of the lower rail 102 to a position in which the engagement between the cam surface 252 and the interior wall 119, as well as between the interior curved surface 254 and the outermost one of the upper ends 120 of the lower rail 102, retains the lower rail connector 206 to the lower rail 102.

As shown in FIGS. 20 to 22B, when the upper rail connector 204 engages the upper rail 74, the locking member 264 of the locking assembly 260 is in its unlocked position and the latch 276 is not received in the latch-receiving recess 291. As can be seen in FIG. 22A, the lower protruding portion 272 of the fixed member 262 is received in a recess 87 formed on the outer side of the upper rail 74. Notably, the recess 87 is defined by the wide upper portion 79, the wide lower portion 81 and the narrow intermediate portion 83 of the upper rail 74. The lower protruding portion 272 is shaped and dimensioned so that a close fit exists between the lower protruding portion 272 and the surfaces defining the recess 87. This can help provide a better interlock between the upper rail connector 204 and the upper rail 74. Moreover, at this stage, the wide upper portion 79 of the upper rail 74 is disposed between the lower and upper protruding portions 272, 274 of the fixed member 262. The pivot member 266 is thus disposed above the wide upper portion 79 of the upper rail 74.

In order to lock the locking assembly 260 to the upper rail 74, the locking member 264 is first placed in the position shown in FIGS. 20 to 22B. In this position, the locking member 264 is inclined with the pivot member 266 extending upwardly, and the hook tip 288 of the hook portion 286 is disposed in a recess 89 formed on the inner side of the upper rail 74 (opposite the recess 87 on the outer side). Notably, the recess 89 is defined by the wide upper portion 79, the wide lower portion 81 and the narrow intermediate portion 83 of the upper rail 74. As such, the hook tip 288 and the lower protruding portion 272 are disposed on opposite sides of the upper rail 74. At this point, the locking assembly 260 is ready to be locked onto the rail 74.

The locking member 264 is then pivoted downward (about the axes 280, 282) to its locked position so that the locking assembly 260 locks onto the rail 74, as shown in FIGS. 24 to 29. As the locking member 264 is pivoted downward, a lower edge of the locking member 264 at the outer end portion 284 slips over the curved outer surface 279 of the latch 276 and the locking member 264 moves the latch 276 inwardly until the latch 276 is received in the latch-receiving recess 291 of the locking member 264. At this point, the latch 276 is permitted to move back to its original position, where it prevents the locking member 264 from moving back to the unlocked position.

Figure 29:
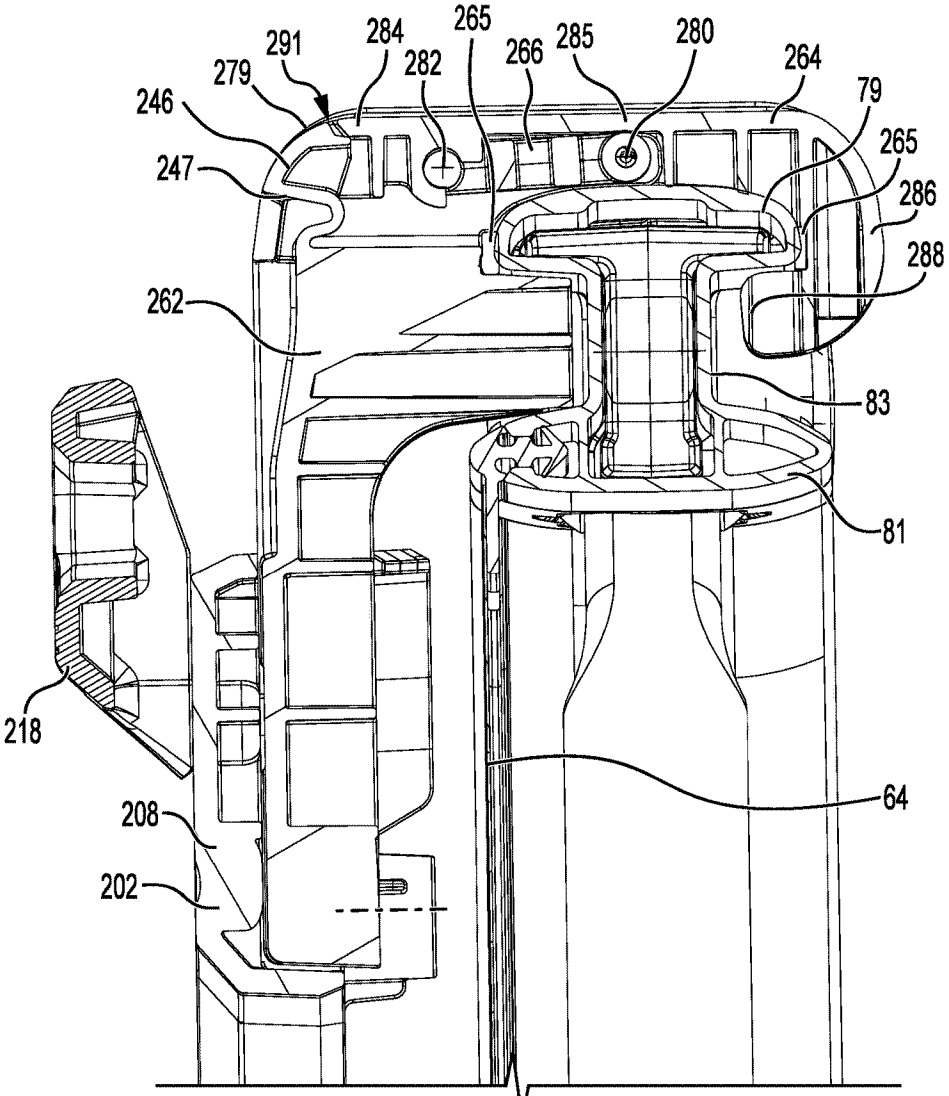
FIG. 29 is a detailed view of part of the cross-section of FIG. 28, showing a connection between the upper rail and the upper rail connector of the barrier accessory device.

As shown in FIG. 29, in the locked position of the locking member 264, the fixed member 262 and the locking members 264, together, form a shape that interlocks with a shape of the cross-sectional profile of the upper rail 74. In particular, the fixed member 262 and the locking member 264 together define a recess 295 (best shown in FIG. 14) that has generally the same shape as the cross-sectional profile of the wide upper portion 79 of the upper rail 102. As such, in the locked position of the locking member 264, the fixed member 262 and the locking member 264 together surround a majority of the wide upper portion 79 of the cross-sectional profile of the upper rail 102 (at the portion of the upper rail 102 to which the locking assembly 260 is locked onto). Notably, the shape formed by the fixed member 262 and the locking member 264 interlocks with the wide upper portion 79 and thus securely retains the barrier accessory device 200 with the barrier structure 50.

It is contemplated that, in other embodiments, the shape formed by the fixed member 262 and the locking member 264 when the locking member 264 is in the locked position could be different. Notably, in other embodiments, either one of the fixed member 262 and the locking member 264 could not extend into the recesses 87, 89 respectively and instead present a flat surface that only abuts the wide upper portion 79 of the cross-sectional profile of the upper rail 74.

Furthermore, as shown in FIG. 29, in this embodiment, the locking assembly 260 includes two gripping members 265 to improve a grip of the locking assembly 260 on the upper rail 74. The gripping members 265 are fixed (e.g., glued) to respective inner surfaces of the fixed member 262 and the locking member 264. One of the gripping member 265 is fixed to the fixed member 262 at an inner surface thereof, between the lower and upper protruding portions 272, 274. The other gripping member 265 is fixed to the locking member 264 at an inner surface thereof, between the hook tip 288 and the middle portion 285 of the locking member 264. The grip members 265 are made of an anti-slip material. More specifically, in this embodiment, the gripping members 265 are made of a thermoplastic elastomer (TPE). The gripping members 265 may be omitted in other embodiments.

In order to remove the barrier accessory device 200 from the barrier structure 50, the locking member 264 is moved to the unlocked position. To do this, in this embodiment, the latch 276 is pushed inwardly by the user into the latch-receiving recess 291 until the lower latching surface 277 no longer prevents the locking member 264 from pivoting upwardly about the axes 280, 282. As can be seen, when the upper rail connector 204 engages the upper rail 74, the pivot axes 280, 282 extend in a direction generally parallel to the upper rail 74 at a portion thereof to which the locking assembly 260 is locked onto. Thus when the locking member 264 pivots from the locked position to the unlocked position, the locking member 264 pivots inwardly in a direction away from the accessory connection base 202, as permitted by the two pivot axes 280, 282.

As can be understood from the above description, the barrier accessory device 200 allows the user to quickly and toollessly secure/remove the accessory 400 to/from the barrier structure 50. Notably, unlike some conventional storage solutions that are mountable to a barrier structure of a boat and require a tool (e.g., a screwdriver) for doing so, neither of the upper and lower rail connectors 204, 206 requires a tool to be secured to the barrier structure 50. It will also be appreciated that the barrier accessory deice 200 can be disposed at various positions along the barrier structure. In addition, when the barrier accessory device 200 is disposed on the outer side of the barrier structure 50, the accessory 400 that is secured thereto does not occupy any place on the deck 20, thus allowing a greater surface area of the deck 20 to be used for other purposes.

Figure 30:
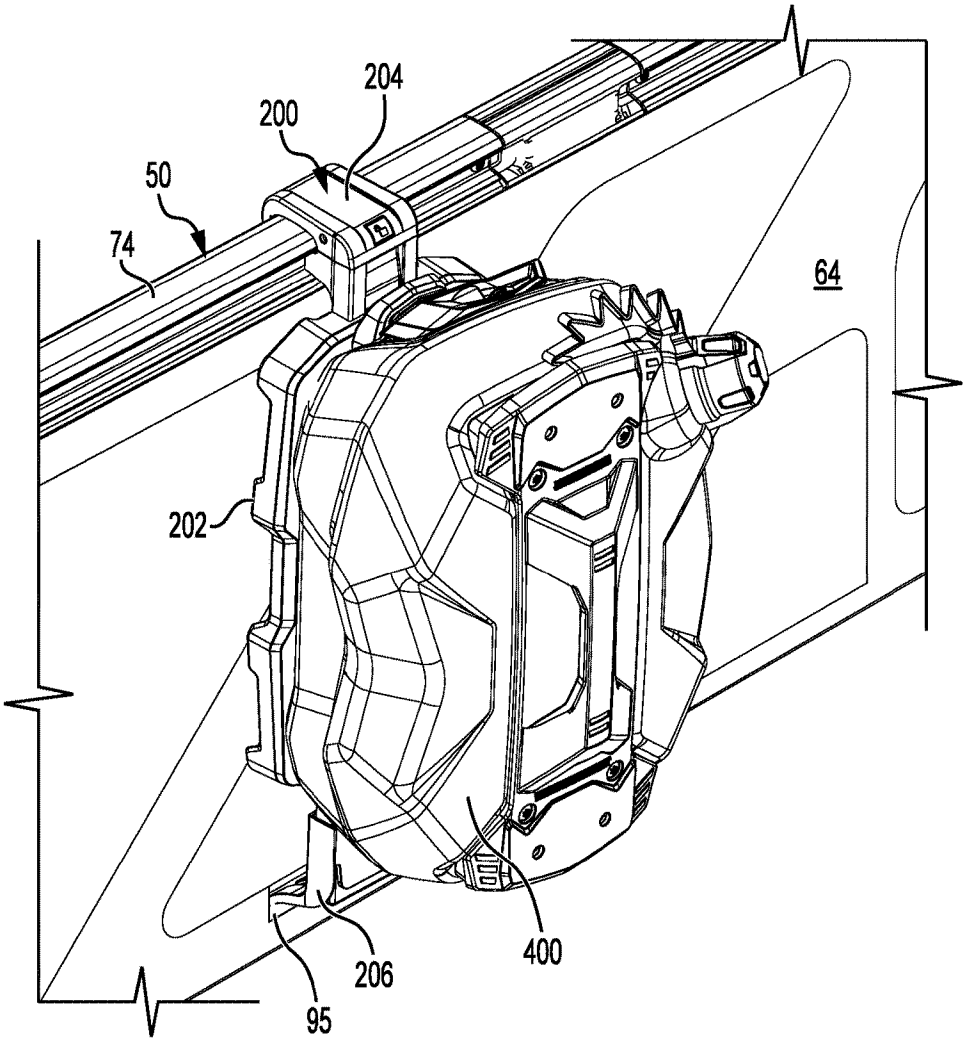
FIG. 30 is a perspective view, taken from a top, front, left side, of an accessory secured, via the barrier accessory device, to the left lateral portion of the barrier structure.
Figure 32:
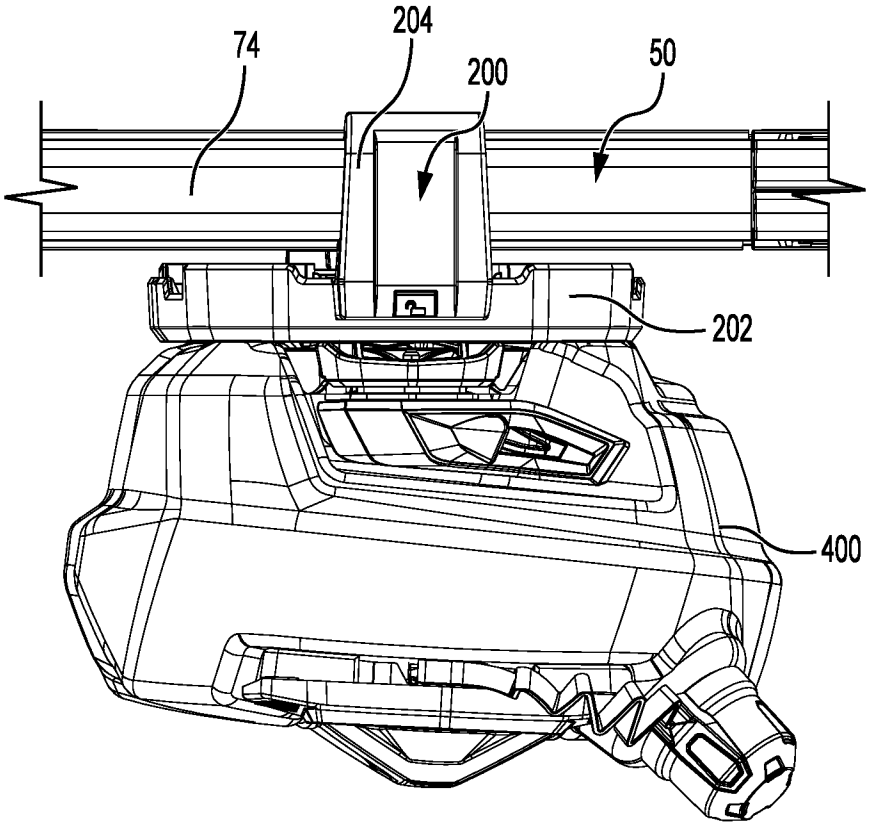
FIG. 32 is a top plan view of the accessory, the barrier accessory device and the left lateral portion of the barrier structure of FIG. 30.
Figure 31:
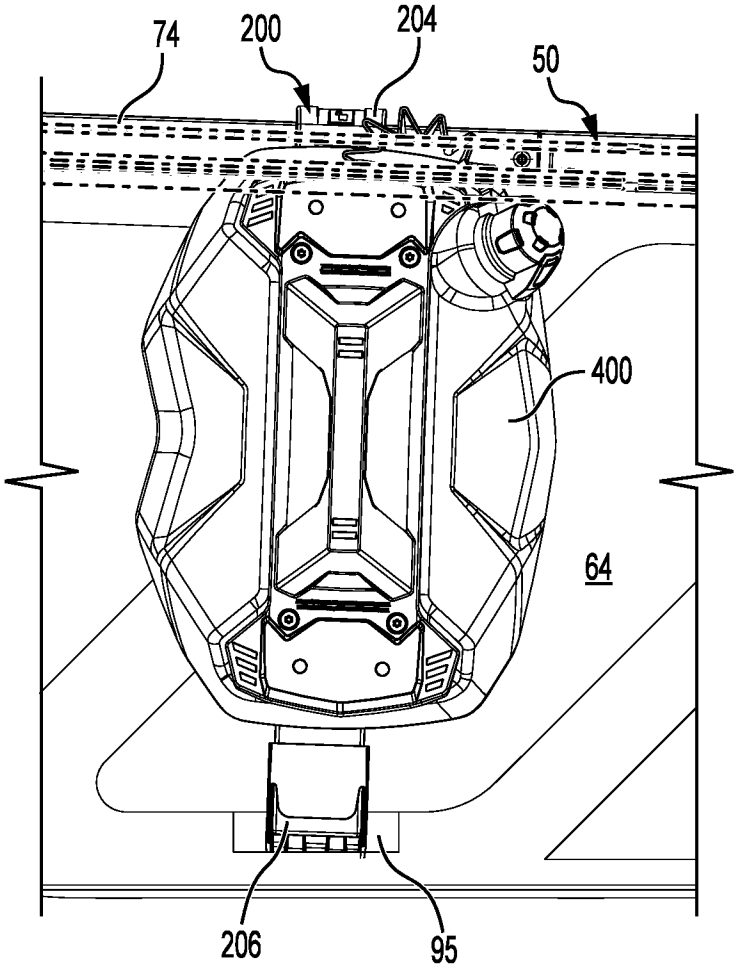
FIG. 31 is a left side elevation view of the accessory, the barrier accessory device and the left lateral portion of the barrier structure of FIG. 30.

While in this embodiment the barrier accessory device 200 is positioned on an outer side of the barrier structure 50, as shown in FIGS. 30 to 32, it is contemplated that the barrier accessory device 200 could be positioned on the inner side of the barrier structure 50. Similarly, while in this embodiment the rail connector 204 is engaged with the upper rail 74 and the rail connector 206 is engaged with the lower rail 102, this may be the opposite in other embodiments. Notably, it is contemplated that the rail connector 204 could be engaged with the lower rail 102 and the rail connector 206 could be engaged with the upper rail 74. Therefore, it should be understood that the terms "outer", "inner", "upper" and "lower" and other words used in reference to the different components of the barrier accessory device 200 are used to facilitate the description thereof and should not be understood as limiting the potential orientation of the barrier accessory device 200 relative to the barrier structure 50.

Furthermore, the lower rail 102 of the barrier structure 50 could be configured otherwise. For instance, in some embodiments, the lower rail 102 of the barrier structure 50 could be comprised by the deck 20. Notably, a molded part of the deck 20 could be generally rail-shaped and define a slot such as the slot 108. Similarly, in some cases, the lower rail 102 may be comprised by the wall 64, namely in embodiments in which the wall 64 is rigid (e.g., a molded wall) forming the slot 108 accessible for installation of the barrier accessory device 200 positioned on the inner and/or outer side of the wall 64. That is, the wall 64 could define the slot 108 to which the lower rail connector 206 is engaged. Furthermore, in some embodiments, the upper rail 74 may be comprised by the wall 64, namely in embodiments in which the wall 64 is rigid (e.g., a molded wall), thereby allowing the barrier accessory device 200 to be secured thereto as described above. For instance, in some embodiments, a boat's gunwale may define the structure of the upper rail 74 and a molded portion of the boat's wall extending beneath the gunwale may define the slot 108 such that the barrier accessory device 200 can be installed thereon.

Figure 24:
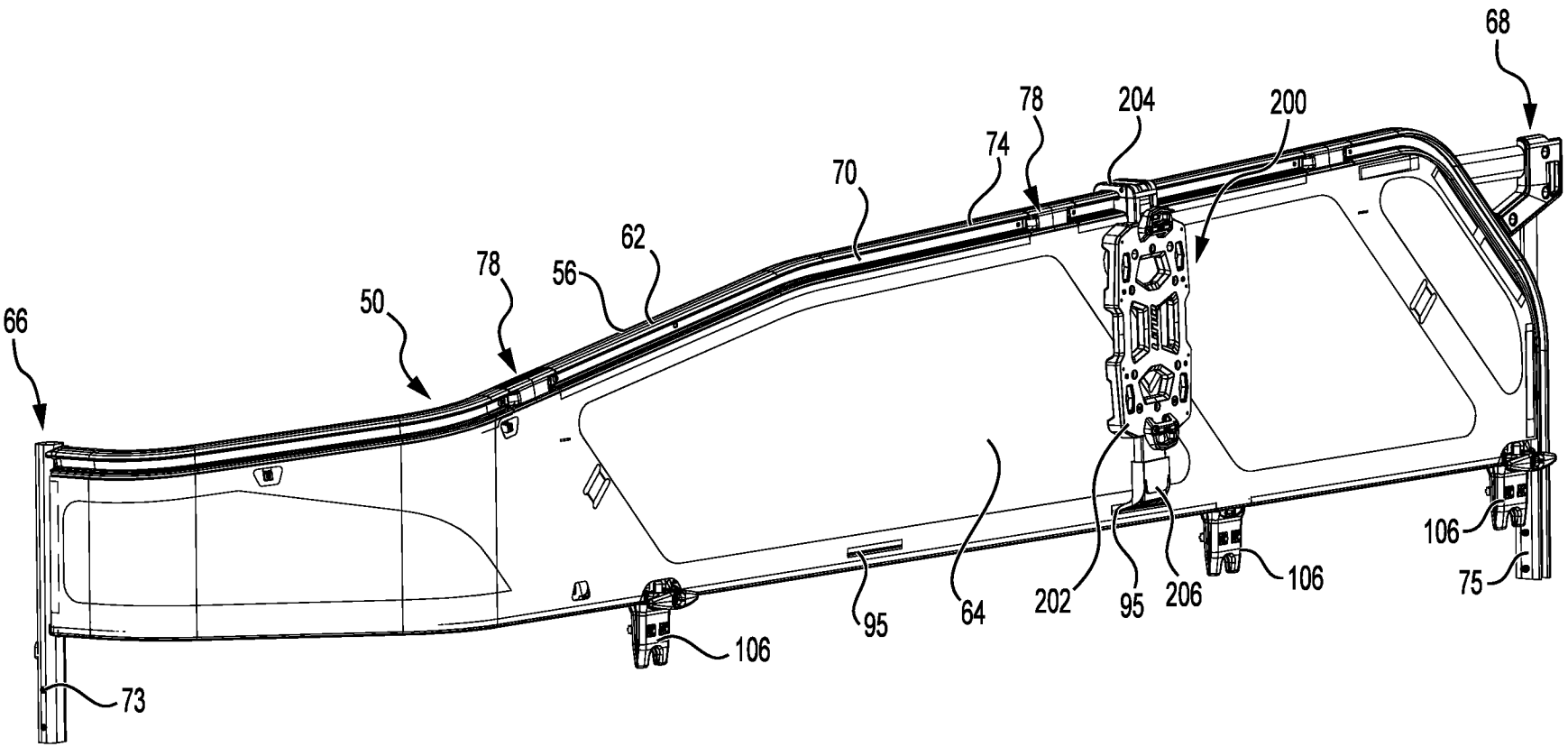
FIG. 24 is a perspective view, taken from a front, left side, of the left lateral portion of the barrier structure and the barrier accessory device, showing the barrier accessory device locked onto the barrier structure.
Figure 25:
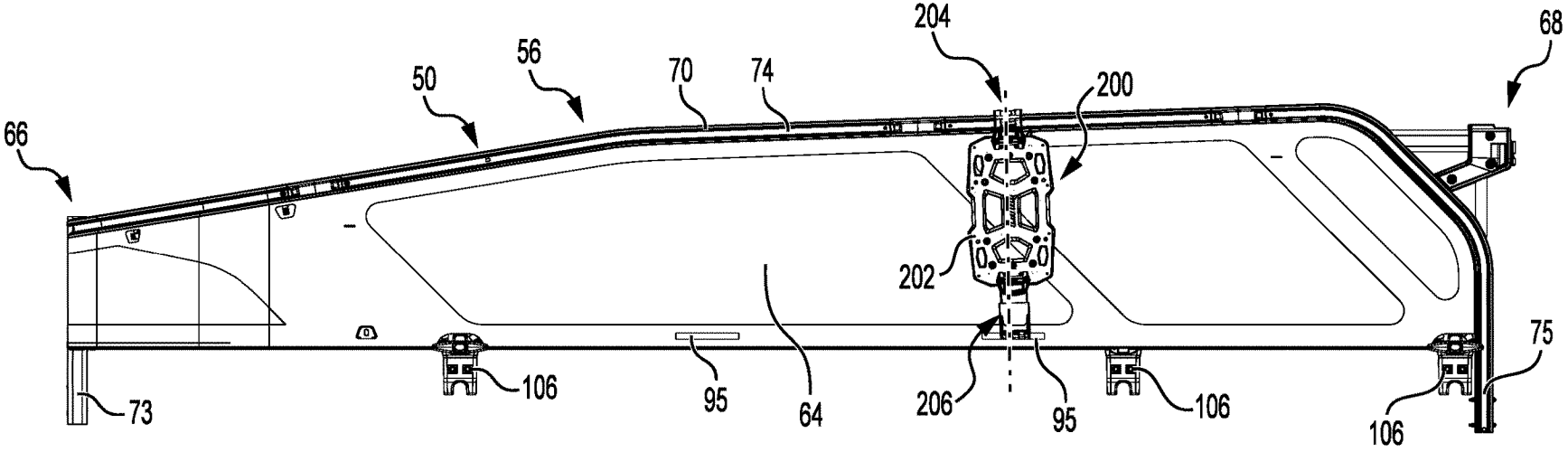
FIG. 25 is a left side elevation view of the left lateral portion of the barrier structure and the barrier accessory device of FIG. 24.
Figure 26:
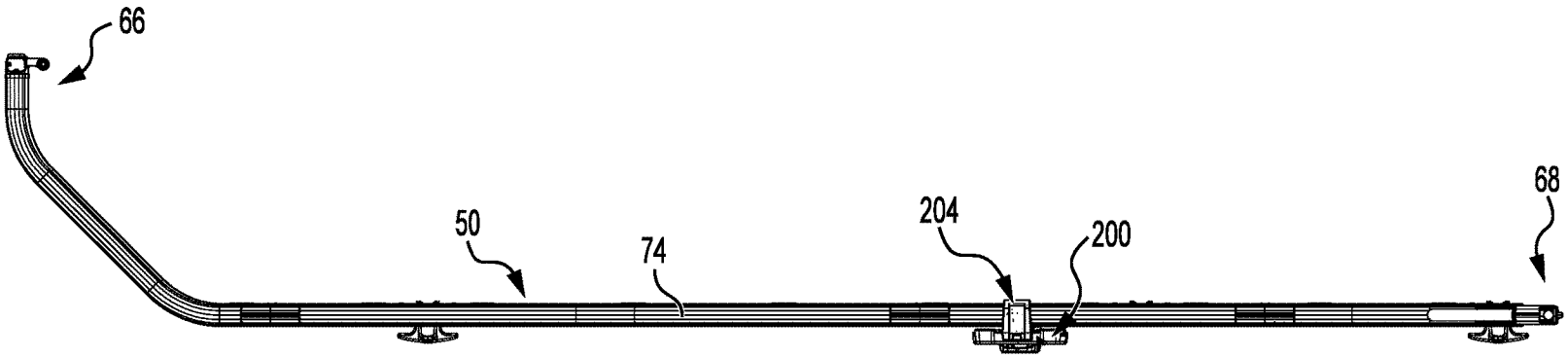
FIG. 26 is a top plan view of the left lateral portion of the barrier structure and the barrier accessory device of FIG. 24.
Figure 27:
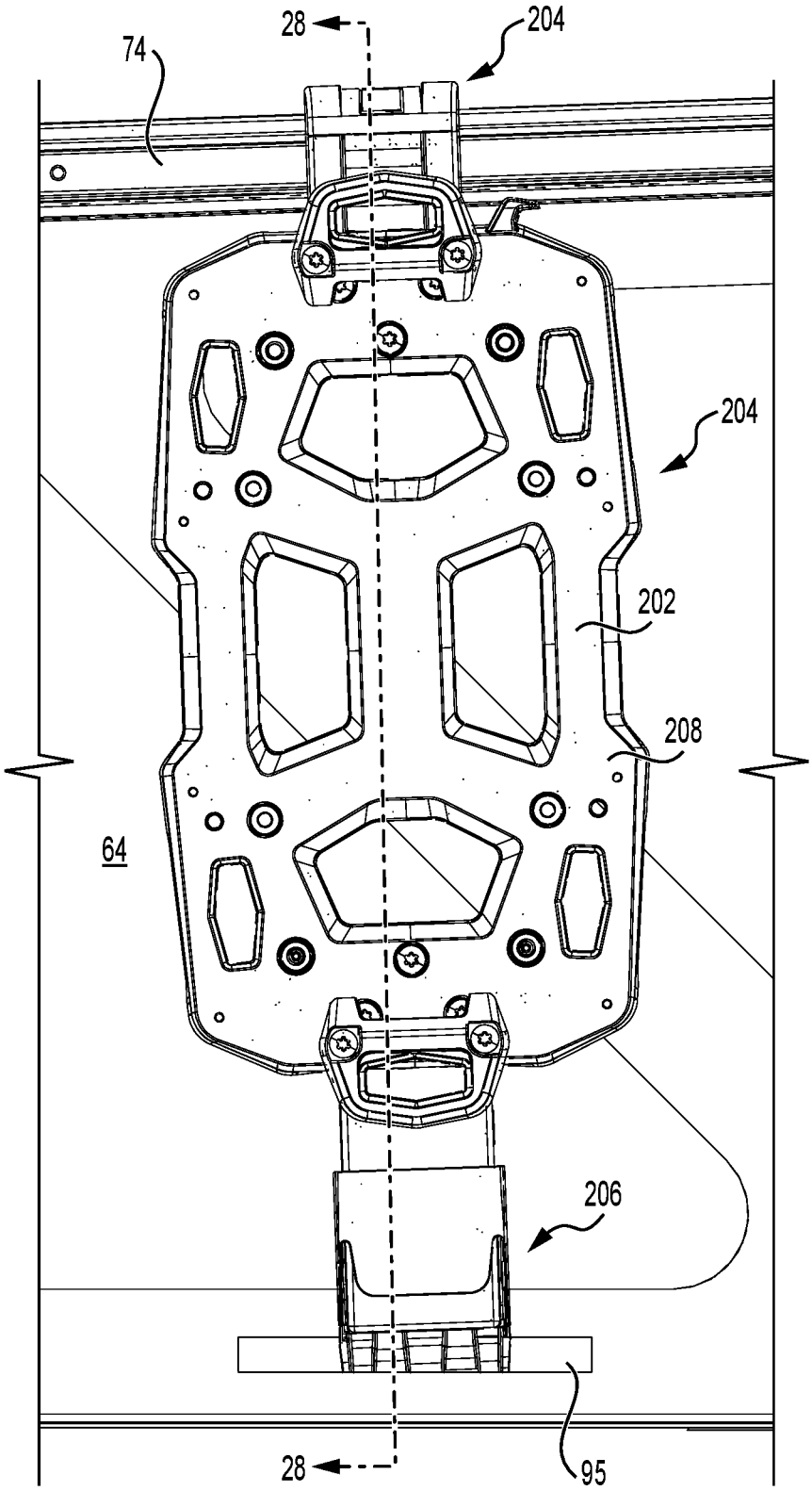
FIG. 27 is a detailed view of part of FIG. 25, showing the barrier accessory device.
Figure 28:
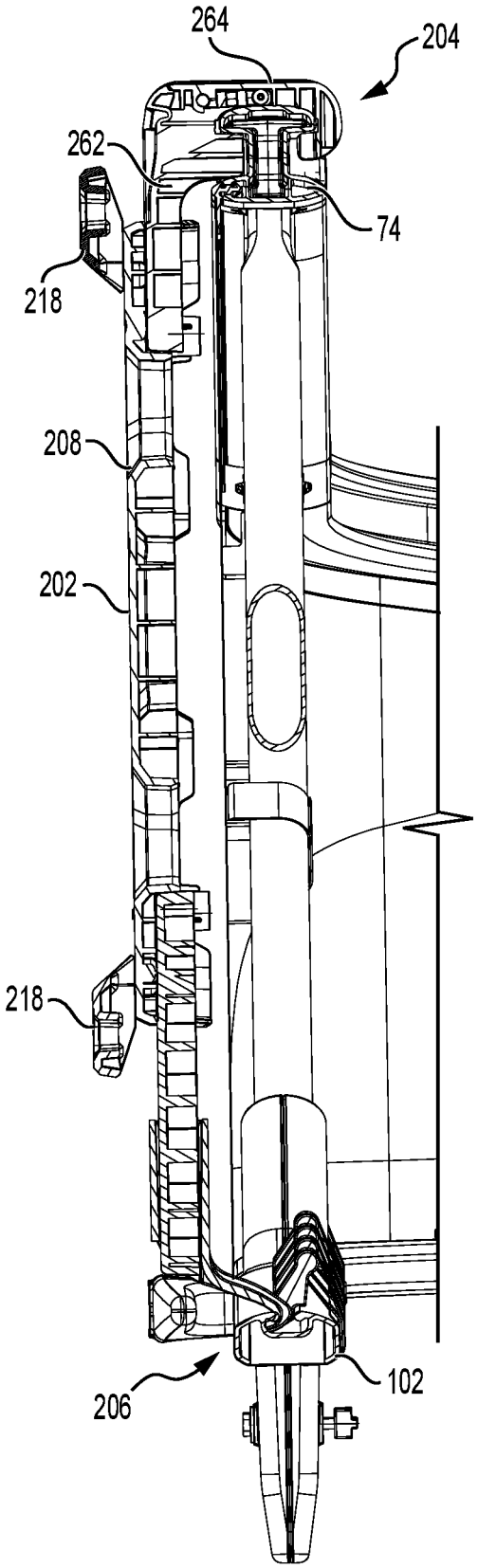
FIG. 28 is a cross-sectional view of the barrier accessory device and part of the left lateral portion of the barrier structure taken along line 28-28 in FIG. 27.

In addition to the position shown in FIGS. 24 to 26, the barrier accessory device 200 could be connected at a plurality of other positions along the left and right lateral portions 56 of the barrier structure 50 of the boat 10. In addition, the barrier accessory device 200 could be connected to a portion of the barrier structure 50 other than one of the left and right lateral portions 56. For instance, in other embodiments, the barrier accessory device 200 could be connected to the front portion 54 or the rear portion 60 of the barrier structure 50.

Modifications and improvements to the above-described embodiments of the present technology may become apparent to those skilled in the art. The foregoing description is intended to be exemplary rather than limiting. The scope of the present technology is therefore intended to be limited solely by the scope of the appended claims.

What is claimed is:

1. A barrier accessory device for a watercraft, the watercraft having a deck and a barrier structure connected to the deck, the barrier structure having upper and lower rails, the barrier accessory device comprising:

an accessory connection base configured for having at least one accessory removably connected thereto;

a first rail connector connected to the accessory connection base at a first end portion thereof, the first rail connector comprising a slot-engaging member configured to be inserted into a slot defined in one of the upper rail and the lower rail; and a second rail connector connected to the accessory connection base at a second end portion thereof opposite the first end portion, the second rail connector comprising a locking assembly configured to be selectively locked onto an other one of the upper rail and the lower rail.

2. The barrier accessory device of claim 1, wherein:

the one of the upper rail and the lower rail is the lower rail;

the first rail connector is a lower rail connector configured to engage the lower rail; and the second rail connector is an upper rail connector configured to engage the upper rail.

3. The barrier accessory device of claim 1, wherein the locking assembly comprises:

a fixed member connected to the accessory connection base; and a locking member operatively connected to the fixed member, the locking member being movable relative to the fixed member between:

a locked position for the locking assembly to lock onto the other one of the upper rail and the lower rail; and an unlocked position for the locking assembly to release the other one of the upper rail and the lower rail.

4. The barrier accessory device of claim 3, wherein:

the locking assembly further comprises a pivot member pivotably connecting the locking member to the fixed member; and the locking member is pivotable between the locked and unlocked positions about a pivot axis defined by the pivot member.

5. The barrier accessory device of claim 4, wherein, in use, the pivot axis extends in a direction generally parallel to the other one of the upper rail and the lower rail at a portion thereof to which the locking assembly is locked onto.

6. The barrier accessory device of claim 4, wherein:

the pivot axis is a first pivot axis;

the locking member is pivotable relative to the fixed member about a second pivot axis defined by the pivot member; and the first pivot axis is generally parallel to the second pivot axis.

7. The barrier accessory device of claim 6, wherein:

the pivot member comprises a first pivot feature and a second pivot feature defining the first pivot axis and the second pivot axis respectively;

the first pivot feature is pivotably connected to the fixed member; and the second pivot feature is pivotably connected to the locking member.

8. The barrier accessory device of claim 3, wherein:

one of the fixed member and the locking member comprises a latch;

an other one of the fixed member and the locking member defines a latch-receiving recess;

in the locked position of the locking member, the latch is received and retained in the latch-receiving recess; and in the unlocked position of the locking member, the latch is removed from the latch-receiving recess.

9. The barrier accessory device of claim 3, wherein, in the locked position of the locking member, the fixed member and the locking member are configured to, together, form a shape that interlocks with a shape of a cross-sectional profile of the other one of the upper rail and the lower rail.

10. The barrier accessory device of claim 9, wherein:

the cross-sectional profile is generally I-shaped and has:

a wide upper portion;

a wide lower portion; and a narrow intermediate portion extending between the wide upper and lower portions;

and in the locked position of the locking member, the shape formed by the fixed member and the locking member interlocks with at least part of the generally I-shaped cross-sectional profile.

11. The barrier accessory device of claim 10, wherein the fixed member comprises a protruding portion configured to extend into a recess on one side of the cross-sectional profile, the recess being defined by the wide upper portion, the wide lower portion and the narrow intermediate portion.

12. The barrier accessory device of claim 10, wherein the locking member comprises a hook portion configured to extend into a recess on one side of the cross-sectional profile, the recess being defined by the wide upper portion, the wide lower portion and the narrow intermediate portion.

13. The barrier accessory device of claim 10, wherein, in use, in the locked position of the locking member, the fixed member and the locking member together surround at least a majority of the wide upper portion of the cross-sectional profile.

14. The barrier accessory device of claim 1, wherein the slot-engaging member is generally hook-shaped.

15. The barrier accessory device of claim 1, wherein a position of at least one of the first and second rail connectors is adjustable relative to the accessory connection base.

16. The barrier accessory device of claim 1, wherein:

the accessory connection base comprises at least one accessory attachment feature configured to removably connect the accessory thereto.

17. The barrier accessory device of claim 16, wherein:

at least one of the at least one accessory attachment feature is an opening defined by the accessory connection base, the opening having a shape corresponding to a shape of an accessory attachment feature connected to the accessory.

18. The barrier accessory device of claim 16, wherein the at least one accessory attachment feature includes:

a first anchor fixture disposed at the first end portion of the accessory connection base, the first anchor fixture defining a fastener aperture configured to receive a tongue connected to the accessory; and a second anchor fixture disposed at the second end portion of the accessory connection base, the second anchor fixture defining an anchor aperture configured to receive an anchor connected to the accessory, the first anchor fixture and the second anchor fixture collaboratively retaining the accessory to the accessory connection base.

19. A watercraft comprising:

a deck;

a hull supporting the deck;

a barrier structure connected to the deck, the barrier structure comprising:

an upper rail; and a lower rail extending below the upper rail; and the barrier accessory device of claim 1 mounted to the barrier structure.

20. The watercraft of claim 19, further comprising an accessory mounted to the accessory connection base of the barrier accessory device.

* * * * *